US008006802B2

(12) United States Patent
Honji

(10) Patent No.: US 8,006,802 B2
(45) Date of Patent: Aug. 30, 2011

(54) ACOUSTIC STRUCTURE AND ACOUSTIC ROOM

(75) Inventor: Yoshikazu Honji, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/584,180

(22) Filed: Sep. 1, 2009

(65) Prior Publication Data

US 2010/0065369 A1 Mar. 18, 2010

(30) Foreign Application Priority Data

Sep. 2, 2008 (JP) ..... 2008-225317

(51) Int. Cl.

| | |
|---|---|
| ***E04B 1/82*** | (2006.01) |
| ***E04B 1/84*** | (2006.01) |
| *E04B 1/74* | (2006.01) |
| *E04B 1/62* | (2006.01) |
| *E04B 1/99* | (2006.01) |

(52) U.S. Cl. ..... 181/293; 181/295

(58) Field of Classification Search ..... 181/293, 181/295, 286, 284, 206, 210; 52/144, 145
See application file for complete search history.

(56) References Cited

U.S. PATENT DOCUMENTS

| | | | | |
|---|---|---|---|---|
| 3,275,101 | A * | 9/1966 | Davis, Jr et al. | 181/285 |
| 4,076,100 | A * | 2/1978 | Davis | 181/290 |
| 4,189,027 | A * | 2/1980 | Dean et al. | 181/286 |
| 4,231,447 | A * | 11/1980 | Chapman | 181/213 |
| 4,821,839 | A * | 4/1989 | D'Antonio et al. | 181/198 |
| 4,821,841 | A * | 4/1989 | Woodward et al. | 181/286 |
| 5,457,291 | A * | 10/1995 | Richardson | 181/293 |
| 5,512,715 | A * | 4/1996 | Takewa et al. | 181/295 |
| 5,598,669 | A * | 2/1997 | Hamdi et al. | 52/144 |
| 5,959,265 | A * | 9/1999 | Van Ligten | 181/286 |
| 6,021,612 | A * | 2/2000 | Dunn et al. | 52/144 |
| 6,167,985 | B1 * | 1/2001 | Van Ligten | 181/286 |
| 6,290,022 | B1 * | 9/2001 | Wolf et al. | 181/292 |
| 6,435,303 | B1 * | 8/2002 | Warnaka | 181/286 |

(Continued)

FOREIGN PATENT DOCUMENTS

| | | |
|---|---|---|
| JP | 06026130 A * | 2/1994 |
| JP | 07-302087 | 11/1995 |
| JP | 2002-030744 | 1/2002 |
| JP | 2003-097037 | 4/2003 |
| WO | WO 96/23294 A1 | 8/1996 |

OTHER PUBLICATIONS

European Patent Office "Extended Search Report" dated Apr. 5, 2011, Application No. 09011270.7, 7 pages.

*Primary Examiner* — Edgardo San Martin
(74) *Attorney, Agent, or Firm* — Pillsbury Winthrop Shaw Pittman LLP

(57) ABSTRACT

In a hollow member, a portion of a hollow region adjoining and communicating with an opening portion is constructed as an intermediate layer. The intermediate layer is constructed in such a manner that, when a reflective surface radiates reflected waves corresponding to incident sound waves falling from an external space on the opening portion and the reflective surface of the hollow member, a phase, in the opening portion, of reflected waves produced by resonance of the resonator in response to the incident waves differs from a phase of reflected waves on the reflective surface, and that the absolute value of a value obtained by dividing a specific acoustic impedance of the opening portion by a characteristic impedance of a medium of the opening portion is less than one. A sound absorbing effect through resonance-based action in the opening portion and a sound scattering effect through a flow of gas molecules.

16 Claims, 13 Drawing Sheets

U.S. PATENT DOCUMENTS

| | | | | |
|---|---|---|---|---|
| 6,892,856 | B2 * | 5/2005 | Takahashi et al. | 181/293 |
| 7,314,114 | B2 * | 1/2008 | Gardner et al. | 181/293 |
| 2002/0017426 | A1 * | 2/2002 | Takahashi et al. | 181/293 |
| 2003/0006090 | A1 * | 1/2003 | Reed | 181/210 |
| 2005/0098379 | A1 * | 5/2005 | Sato et al. | 181/293 |
| 2008/0308061 | A1 * | 12/2008 | Yokota | 123/184.57 |

* cited by examiner

ACOUSTIC STRUCTURE AND ACOUSTIC ROOM

BACKGROUND

The present invention relates to sound absorbing and sound scattering techniques.

Acoustic members for scattering sounds are installed to preclude acoustic troubles, such as flatter echoes, in an acoustic space like a hall or theater. Japanese Patent Application Laid-open Publication No. 2002-30744, for example, discloses an acoustic structure which includes a plurality of members each having a cavity extending in one direction and an opening portion communicating the cavity with an external space. Once sound waves of a sound enter the cavity, the sound is re-radiated through the opening portion, so that there can be achieved a sound scattering effect.

In a relatively small space, such as a living room of an ordinary house or music room, it is required to obtain an appropriate sound scattering effect and sound absorbing effect. If acoustic members for obtaining the sound scattering effect and acoustic members for obtaining the sound absorbing effect are separately provided in the space, however, these acoustic members would take up much of the space. Further, if a porous sound absorbing material, such as felt, is used to enhance the sound absorbing effect for low frequency bands, then the acoustic members would increase in dimension in the thickness direction, taking up even more of the space.

SUMMARY OF THE INVENTION

In view of the foregoing, it is an object of the present invention to provide a technique for not only effectively scattering and/or absorbing a sound but also achieving a sound scattering effect and/or a sound absorbing effect over wide frequency bands while restraining an increase in size of acoustic members.

In order to accomplish the above-mentioned object, the present invention provides an improved acoustic structure, which comprises a hollow member having: a hollow region formed therein to extend in a single direction; an opening portion communicating the hollow region with an external space; and a reflective surface facing the external space and adjoining the opening portion. Portion of the hollow region adjoining and communicating with the opening portion in the hollow member is constructed as an intermediate layer, and a portion of the hollow member extending from one end of the hollow region to the intermediate layer is constructed as a resonator. The intermediate layer is constructed in such a manner that, when the reflective surface radiates reflected waves corresponding to incident sound waves falling from the external space on the opening portion and the reflective surface of the hollow member, the intermediate layer not only causes reflected waves, produced through resonance of the resonator and differing in phase from the reflected waves from the reflective surface, to be radiated from the opening portion but also makes substantially zero a real part of a value, obtained by dividing a specific acoustic impedance of the opening portion at the time of the radiation of the reflected waves from the opening portion, by characteristic impedance of a medium of the opening portion.

Preferably, the intermediate layer is constructed in such a manner that, when the reflective surface radiates the reflected waves corresponding to the incident sound waves falling from the external space on the opening portion and the reflective surface of the hollow member, an absolute value of the value, obtained by dividing the specific acoustic impedance of the opening portion by the characteristic impedance of the medium of the opening portion is less than one.

Preferably, a portion of the hollow member extending from one end of the hollow region to the intermediate layer is constructed as a first resonator, and another portion of the hollow member extending from the other end of the hollow region to the intermediate layer is constructed as a second resonator.

Preferably, one resonator of the aforementioned construction is constructed or provided in the hollow region, and the intermediate layer is constructed in such a manner that a surface thereof other than a boundary surface with the resonator adjoins an inner surface of the hollow member or faces the opening portion.

Preferably, the intermediate layer is constructed in such a manner that sound pressure is distributed uniformly when the resonator resonates.

Preferably, a boundary surface between the resonator and the intermediate layer has an area greater than an area of the opening portion.

Preferably, the acoustic structure comprises a plurality of the hollow members arrayed side by side in a direction perpendicular to a direction where the hollow members extend.

Preferably, the plurality of the hollow members differ from each other in length from one end of the hollow region to the intermediate layer.

According to another aspect of the present invention, there is provided an acoustic room comprising the acoustic structure of the present invention constructed in the aforementioned manner.

The present invention arranged in the above-described manner can not only effectively scatter and absorb sounds but also achieve an appropriate sound scattering effect and/or absorbing effect over wide frequency bands, while restraining increase in size of acoustic members.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
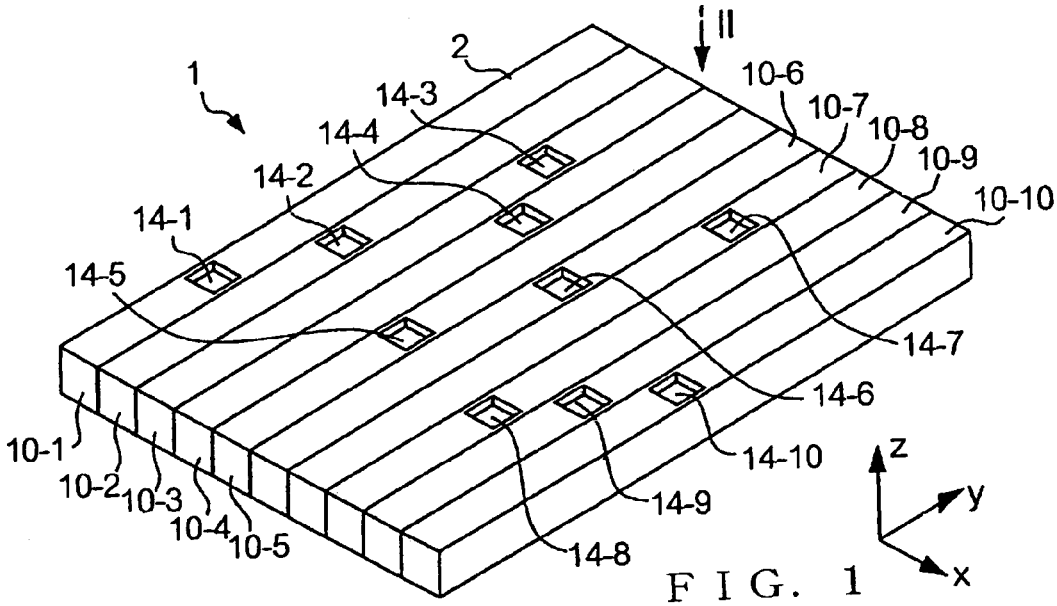
FIG. 1 is a perspective view showing an outer appearance of an acoustic structure according to an embodiment of the present invention.

FIG. 1 is a perspective view showing an outer appearance of an acoustic structure 1 according to an embodiment of the present invention. As shown, the acoustic structure 1 is of a rectangular parallelepiped shape having a small dimension in its width direction, and it includes a plurality of (ten in the illustrated example) hollow members 10-1-10-10 each having a rectangular cylindrical shape and extending in a same single direction. The hollow members 10-1-10-10 are arrayed in a direction perpendicular to the direction in which they extend (i.e., "extending direction") and in such a manner that their respective ends align with one another, and they are bonded together as an integral unit by adhesion or the like. Further, the hollow members 10-1-10-10 are each formed of a reflective material having a relatively high rigidity coefficient, such as acryl resin. Furthermore, the acoustic structure 1 has a generally flat reflective surface constituted by the respective one reflective surfaces 2 of the hollow members 10-1-10-10. The reflective surface 2 faces an external space around the acoustic structure 1 and radiates reflected waves in response to sound waves falling thereon from the external space. Also, the acoustic structure 1 has opening portions 14-1-14-10 formed in individual ones of the hollow members 10-1-10-10 that open to the surfaces of the hollow members 10-1-10-10 to communicate with the external space where sounds transmit or propagate.

Whereas the number of the hollow members constituting the acoustic structure 1 is ten in the illustrated example of FIG. 1, it is just one example and may be smaller than or greater than ten as long as it is at least one. For convenience of description, the direction in which the hollow members 10-1-10-10 extend ("extending direction") will hereinafter be referred to as "y direction", the direction in which the hollow members 10-1-10-10 are arrayed side by side will hereinafter be referred to as "x direction", and a direction vertical to the reflective surface 2 and perpendicular to the x and y directions will hereinafter be referred to as "z direction".

Figure 2:
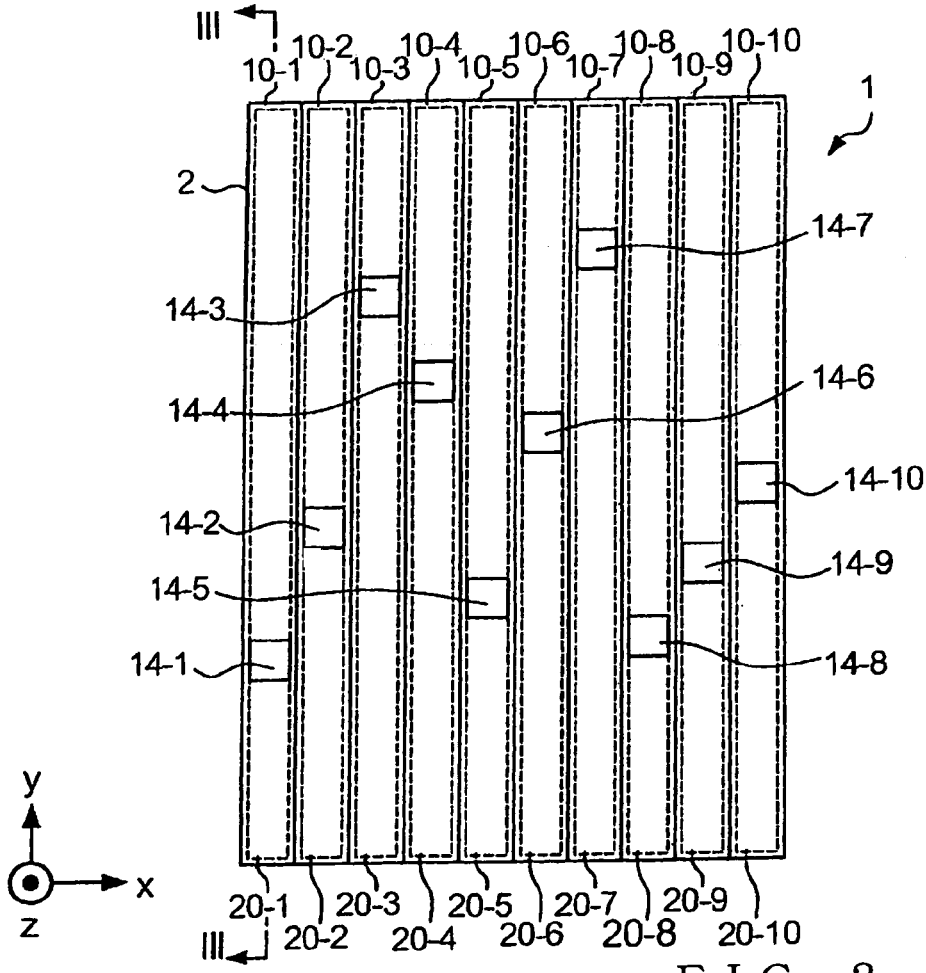
FIG. 2 is a view of the acoustic structure taken in a direction of an arrow II in FIG. 1.

FIG. 2 is a view of the acoustic structure 1 taken in a direction of an arrow II that is vertical to the reflective surface 2. The hollow members 10-1-10-10 have their respective hollow interior regions (hereinafter "hollow region") 20-1-20-10 as indicated by broken lines in FIG. 2. The hollow regions 20-1-20-10 extend (i.e., are elongated) in the y direction and are arrayed in the x direction perpendicular to the y direction. The hollow regions 20-1-20-10 do not reach to the opposite ends of the corresponding hollow members 10-1-10-10 and are closed at their respective opposite ends. Further, the opening portions 14-1-14-10 differ from one another in position in the y direction (or extending direction of the hollow members). With such arrangements, the hollow regions 20-1-20-10 of the hollow members 10-1-10-10 differ from one another in length from one end of the hollow region to the later-described intermediate layer 13.

The following describe in more detail the construction of the hollow members 10-1-10-10. The hollow members 10-1-10-10 are identical in construction, except that the opening portions 14-1-14-10 differ in position, among the hollow members 10-1-10-10, as seen in FIGS. 1 and 2. Thus, in the following description, the hollow members, opening portions and hollow regions constituting the acoustic structure 1 will be collectively referred to as "hollow member 10", "opening portion 14" and "hollow region 20", respectively.

Figure 3:
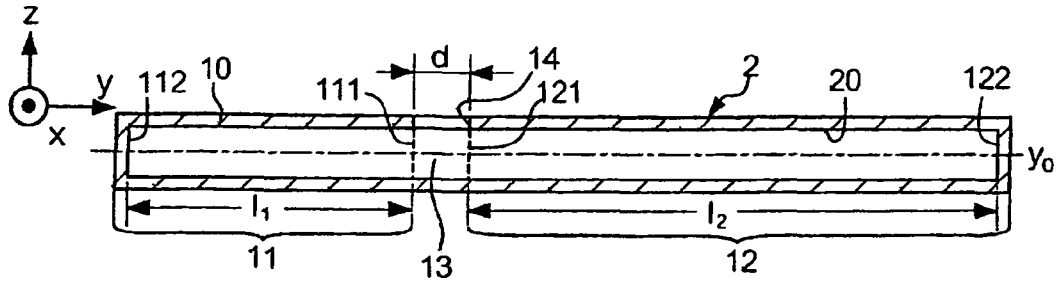
FIG. 3 is a sectional view of a hollow member of the acoustic structure taken along the III-III line of FIG. 2.

FIG. 3 is a sectional view of the hollow member 10 taken along the III-III line (a direction parallel to y-z plane) of FIG. 2. As shown in FIGS. 2 and 3, the hollow region 20 of the hollow member 10 is in the shape of a rectangular parallelepiped extending in the y direction and is closed at its opposite ends 112 and 122.

The hollow member 10 generally comprises two resonators 11 and 12, an intermediate layer 13, and the opening portion 14. The resonator 11 is constructed as a first resonator provided to extend between the one end 112 of the hollow member 10 and a boundary surface 111 between the resonator 11 and the intermediate layer 13. The resonator 12 is constructed as a second resonator provided to extend between the other end 122 of the hollow member 10 and a boundary surface 121 located opposite to the boundary surface 111 and between the resonator 12 and the intermediate layer 13. Once sound waves of a resonant frequency arrive at or fall on the hollow member 10, the resonators 11 and 12 resonate and radiate reflected waves, produced by the resonance, to the external space via the intermediate layer 13 and the opening portion 14. These resonators 11 and 12 are interconnected via the intermediate layer 13 and extend coaxially, or in such a manner that they share a same center axis $y_o$.

The resonator 11 has a length in the y direction, and the resonator 12 has a length $l_2$ in the y direction. Further, the boundary surface 111 between a portion of the hollow region 20 constructed as the resonator 11 and the intermediate layer 13 has an area $S_p$, and the boundary surface 121 between another portion of the hollow region 20 constructed as the resonator 12 and the intermediate layer 13 too has an area $S_p$. Each of the resonators 11 and 12 also has a sectional area $S_p$ along a direction parallel to the x-y plane and vertical to the extending direction of the hollow region 20, and the sectional surface of each of the resonators 11 and 12 has a length in the x-z direction sufficiently smaller than a wavelength $\lambda_1$ or $\lambda_1$ corresponding to the resonant frequency of the resonator 11 or 12, so that sound waves of the resonant frequencies are not distributed in that direction.

The intermediate layer 13 is a portion of the hollow region (i.e., space region or portion) adjoining and communicating directly with the opening portion 14. The intermediate layer 13 is a layer of gas molecules that vibrate to cause sound waves to propagate. As illustrated in FIG. 3, the intermediate layer 13 is a portion of the hollow region that adjoins the opening portion 14 in the vertical direction to communicate the resonators 11 and 12 with the opening portion 14. Namely, the size of the intermediate layer 13 is determined by the size of the opening portion 14 and the size of the section area vertical to the extending direction of the resonators 11 and 12. The intermediate layer 13 faces the resonator 11 via the boundary surface 111 and faces the resonator 12 via the boundary surface 121. Thus, the boundary surfaces 111 and 121 each having the area $S_p$ can each be regarded as a rectangular surface. Here, a medium via which sound waves propagate in the intermediate layer 13 is air, and a medium via which sound waves propagate in the hollow region 20 and in the external space is also air.

As shown in FIGS. 1-3, each of the openings 14 has a square shape as viewed vertically to the reflective surface 2 and communicates the intermediate layer 13 of the hollow region 20 with the external space. Each of the four sides of the opening 14 has a length d that is sufficiently smaller than the wavelengths λ1 and λ2, of the resonant frequencies of the resonators 11 and 12; for example, $d<\lambda_1/6$ and $d<\lambda_2/6$. By satisfying such a condition, it may be regarded that there occurs no sound pressure distribution in the intermediate layer 13 when sound waves of the wavelengths λ1 and λ2 of the resonant frequencies of the resonators 11 and 12, propagate in the intermediate layer 13 (i.e., when the resonators 11 and 12 resonate). Namely, it may be regarded that, when sound waves of the resonant frequencies of the resonators 11 and 12 propagate in the intermediate layer 13, sound pressure is distributed uniformly in the entire intermediate layer 13 without producing nonuniformity in the sound pressure distribution. The reason why the sound pressure is distributed uniformly is that there occurs almost no phase difference in the entire intermediate layer 13 because the length in the direction (i.e., z direction) vertical to the reflective surface 2 of the hollow region 20 and the length d of each of the four sides of the opening portion 14 are each sufficiently smaller than the wavelengths λ1 and λ2. Therefore, "there occurs no sound pressure distribution in the intermediate layer 13" in the instant embodiment means that the nonuniformity in the sound pressure 15 distribution is "zero." Further, "there occurs no sound pressure distribution in the intermediate layer 13" also means a situation where the dimension of the intermediate layer 13 is smaller a threshold dimension shorter than the wavelengths of the resonant frequencies and thus the nonuniformity in the sound pressure distribution in the intermediate layer 13 is less than a threshold value so that there is substantially no sound pressure distribution. If there is no nonuniformity in the sound pressure distribution in the intermediate layer 13, reflected waves from the boundary surface 111 and reflected waves from the opening portion 14 coincide with each other in phase 25 when the resonator 11 has resonated, and reflected waves from the boundary surface 121 and reflected waves from the opening portion 14 coincide with each other in phase when the resonator 12 resonates.

Further, the opening 14 has an area $S_o$ that is smaller than the sectional area $S_p$ of the boundary surface 111, 121 (i.e., $S_p>S_o$). Note that the opening 14 may be of other than a square shape, such as a circular or polygonal shape. If the opening 14 is other than a square shape, there may be employed one side length d of a square having the same area as the area $S_o$ of the opening portion 14 or one side length d of a bounding rectangle or inscribing rectangle of a figure indicative of a shape of the opening 14.

Sound waves falling from the external space on the hollow member 10 arranged in the above-described manner (hereinafter referred to as "incident waves") include those falling on the reflective surface 2 and those falling on the opening portion 14. Of the incident waves, the waves arriving at or falling on the opening portion 14 enter the resonators 11 and 12 via the opening portion 14 and intermediate layer 13. If sound waves of the resonant frequencies of the resonators 11 and 12 are contained in the frequency bands of the incident waves, then the resonators 11 and 12 resonate in response to the incident waves, and there occurs a sound pressure distribution only in the extending direction of the hollow region 20 (i.e., in the y direction). Here, the wavelengths $\lambda_1$ and $\lambda_2$ corresponding to the resonant frequencies of the resonators 11 and 12 satisfy relationship represented by Mathematical Expression (1) below using the respective lengths 11 and 12, in the y direction, of the resonators 11 and 12.

$$l_i=(2n-1)\lambda_i/4(_i=1,2) \quad (1)$$

In Mathematical Expression (1), n is an integral number of 1 or over, and open end correction is not taken into account.

Figure 4:
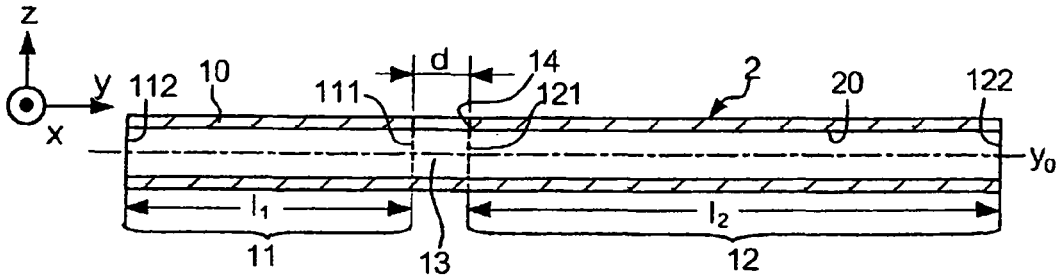
FIG. 4 is a sectional view of a hollow member opened at its opposite ends.

In the hollow member 10, each of the resonators 11 and 12, which is of a so-called closed tube type having the hollow region closed at one end and open at the other end, has the length $l_1$ or $l_2$ that is an even multiple of a quarter of the wavelength $\lambda_1$ or $\lambda_2$ corresponding to the resonant frequency as shown in Mathematical Expression (1); thus, the hollow member 10 can be designed to achieve the intended resonant frequencies with the lengths $l_1$ and $l_2$ determined as above. Whereas the hollow member 10 is closed at both of the opposite ends 112 and 122 in the illustrated example of FIGS. 1-3, it may be open at either or both of the opposite ends 112 and 122 (so-called open tube type). If the hollow member 10 is open at both of the opposite ends 112 and 122 as shown in FIG. 4, the wavelengths $\lambda_1$ and $\lambda_2$ corresponding to the resonant frequencies of the resonators 11 and 12 satisfy relationship defined by Mathematical Expression (2) below using the respective lengths $l_1$ and $l_2$, in the y direction, of the resonators 11 and 12.

$$li=n\cdot\lambda i/2(_i=1,2) \quad (2)$$

In Mathematical Expression (2) too, n is an integral number of 1 or over, and open end correction is not taken into account.

In the case where the opposite ends 112 and 122 are both open (open ends), each of the lengths $l_1$ and $l_2$ is an integral multiple of a half of the wavelength $\lambda_1$ or $\lambda_2$ corresponding to the resonant frequency as shown in Mathematical Expression (2); thus, in this case too, the hollow member 10 can be designed to achieve the intended resonant frequencies.

If $l_1=l_2$, the resonators 11 and 12 have a same resonant frequency. Where the resonators 11 and 12 should have a same resonant frequency, the lengths $l_1$ and $l_2$ are determined to satisfy any one of conditions (I)-(IV) below depending on whether the ends 112 and 122 are open or closed ends. Note that $n_1$ and $n_2$ are each an integral number of 1 or over. Of course, in the case where the ends 112 and 122 are each closed as shown in FIG. 3, it is only necessary that not only the relationship of $l_1=l_2$ but also the condition indicated at (IV) below be satisfied:

(I) In the case where the end 112 of the resonator 11 is an open end while the end 122 of the resonator 12 is a closed end, $$l_1:l_2=2n_1-1:2n_2;$$

(II) In the case where the end 112 of the resonator 11 is a closed end while the end 122 of the resonator 12 is an open end, $$l_1:l_2=2n_1:2n_2-1;$$

(III) In the case where the end 112 of the resonator 11 is an open end and the end 122 of the resonator 12 is also an open end, $$l_1:l_2=n_1:n_2; \text{ and}$$

(IV) In the case where the end 112 of the resonator 11 is a closed end and the end 122 of the resonator 12 is also a closed end, $$l_1:l_2=2n_1:2n_2-1.$$

The following describe the construction and behavior of the hollow member 10 where the ends 112 and 122 are both closed ends, unless otherwise stated. Note, however, that the following same description applies to the hollow member 10 where the ends 112 and 122 are both open ends, except that the hollow member 10 where the ends 112 and 122 are both open ends is different from the hollow member 10 where the ends 112 and 122 are both closed ends in terms of the relationship between the lengths and the resonant frequencies of the resonators 11 and 12.

Figure 5:
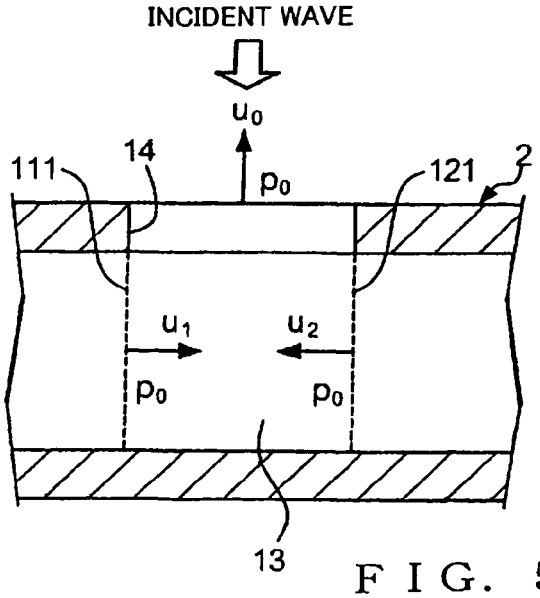
FIG. 5 is a sectional view explanatory of behavior of an intermediate layer of the hollow member when resonators have resonated in response incident waves.

FIG. 5 is a sectional view explanatory of behavior of a portion of the hollow region 20 in the neighborhood of the opening portion 14 when the resonators 11 and 12 have resonated in response incident waves of predetermined frequency bands, containing the resonant frequencies of the resonators 11 and 12, falling on the hollow member 10.

In FIG. 5, sound pressure at the boundary surface 111 is indicated by $p_o$, and $u_1$ indicates a particle velocity of gas molecules acting on the boundary surface 111 in a normal direction of the boundary surface 111. Further, sound pressure at the boundary surface 121 is indicated by $p_o$, and $u_2$ indicates a particle velocity of gas molecules acting on the boundary surface 121 in a normal direction of the boundary surface 121. In the following description, the particle velocity $u_1$ at the boundary surface 111 is indicated in a positive value when the particle velocity acts in a direction from the resonator 11 to the intermediate layer 13, while the particle velocity $u_1$ at the boundary surface 111 is indicated in a negative value when the particle velocity acts in a direction from the intermediate layer 13 to the resonator 11. Further, the particle velocity $u_2$ at the boundary surface 121 is indicated in a positive value when the particle velocity acts in a direction from the resonator 12 to the intermediate layer 13, while the particle velocity $u_2$ at the boundary surface 121 is indicated in a negative value when the particle velocity acts in a direction from the intermediate layer 13 to the resonator 12. Namely, the particle velocity acting in the direction to the intermediate layer 13 is indicated in a positive value. Because the resonators 11 and 12 of the hollow member 10 are constructed to satisfy the condition of $l_1=l_2$, the particle velocity $u_2$ takes a positive value when the particle velocity $u_1$ takes a positive value at the time of resonance of the resonators 11 and 12, but takes a negative value when the particle velocity $u_1$ takes a negative value at the time of resonance. Namely, the particle velocities acting in the directions from the resonators 11 and 12 to the intermediate layer 13 vary in phase with each other.

Further, in FIG. 5, sound pressure at the opening portion 14, constituting a boundary between the intermediate layer 13 and the external space is indicated by $p_o$, and $u_o$ indicates a particle velocity of gas molecules acting in the opening portion 14 in a normal direction of the opening portion 14. The particle velocity acing in a direction from the opening portion 14 to the external space is indicated in a positive value, while the particle velocity acing in a direction from the external space to the opening portion 14 is indicated in a negative value. Here, the reason why the sound pressure at the boundary surfaces 111 and 121 and the opening portion 14 is of the same value $p_o$ is that the hollow member 10 is constructed in such a manner that no sound pressure distribution occurs in the entire intermediate layer 13 when the resonators 11 and 12 have resonated.

If the sound pressure $p_o$ produced at the opening portion 14 by incident waves falling thereon from the external space is defined by a mathematical expression of $p_o(t)=p_o\cdot\exp(j\omega t)$, the particle velocities $u_o$ and $u_2$ at the boundary surfaces 111 and 121 satisfy Mathematical Expression (3) below. The sound pressure $p_o$ is a synthesis of the sound pressure of the incident waves and sound pressure of reflected waves produced in the intermediate layer 13 by resonance of the resonators 11 and 12.

$$u_i(t) = j\cdot\frac{P_0}{\rho c}\frac{\sin(kl_i)}{\cos(kl_i)}\cdot\exp(j\omega t)\ (i = 1, 2), \tag{3}$$

where j indicates an imaginary unit, $p_o$ indicates an amplitude value of the sound pressure, ω indicates an angular velocity, ρc indicates a characteristic impedance of air that is the medium in the external space (ρ is a density of air, and c is a sound velocity in the air), k indicates a wave number (k=ω/c) and t indicates time.

Further, because the intermediate layer 13 is a gas layer comprising gas molecules, it has "incompressibility" with an invariable volume. Namely, the intermediate layer 13 acts to keep its inner pressure constant so that its volume remains constant, although it elastically deforms due to the resonance. The intermediate layer 13 having such characteristics causes the sound pressure, acting from the resonators 11 and 12 via the boundary surfaces 111 and 121, to act directly on the opening portion 14, i.e. a boundary between the intermediate layer 13 and the external space. At that time, a sum between volume velocities acting on the intermediate layer 13 from the boundary surfaces 111 and 121 coincides with a volume velocity acting on the external space from the intermediate layer 13 via the opening portion 14.

Figures 6A, 6B:
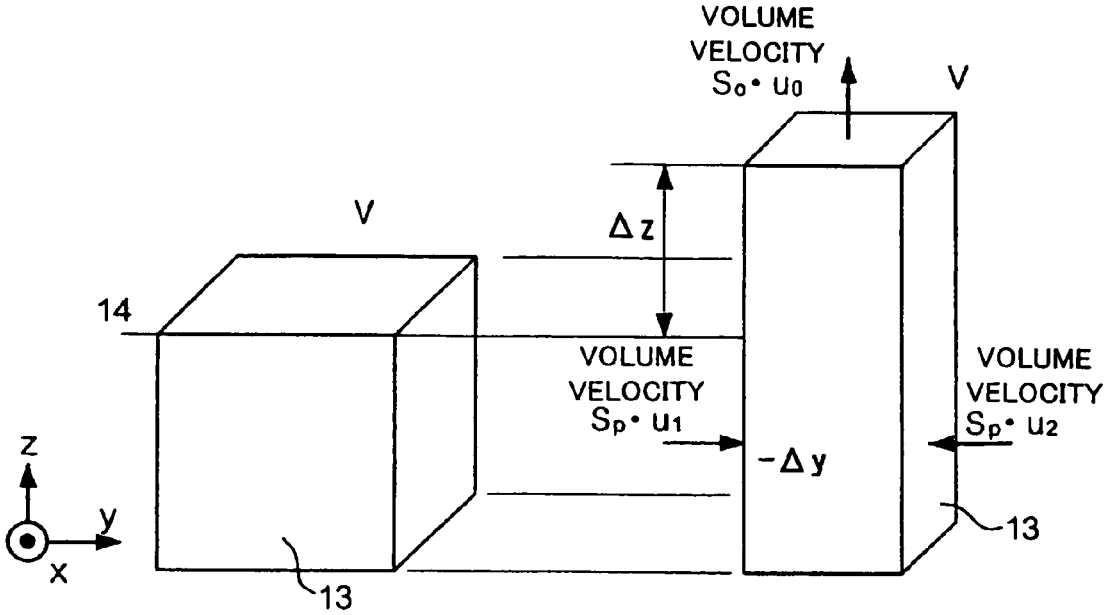
FIGS. 6A and 6B are diagrams explanatory of behavior of the intermediate layer at the time of resonance.

FIG. 6 is a diagram explanatory of behavior of the intermediate layer 13 at the time of resonance when the particle velocities $u_1$ and $u_2$ are each of a positive value. When no incident wave is being received, the intermediate layer 13 has a volume V and a size and shape as shown in FIG. 6A. Once the particle velocities $u_1$ and $u_2$ act in the positive direction, the intermediate layer 13 assumes a state as shown in FIG. 6B. Namely, by the action of the particle velocities $u_1$ and $u_2$, the intermediate layer 13 decreases in dimension in the y direction by Δy and increases in dimension in the z direction by Δz. However, the intermediate layer 13 maintains the volume V because of its incompressibility. Namely, at the time of resonance, when the particle velocities $u_1$ and $u_2$ are each of a positive value, the particle velocity $u_0$ acting from the opening portion 14 on the external space takes on a positive value, so that the intermediate layer 13 assumes a state as if it were projecting to the external space of the hollow member 10 via the opening portion 14. Namely, at the time of resonance, the volume velocities acting on the intermediate layer 13 from the resonators 11 and 12 are added up so that the sum between the volume velocities acts on the external space of the hollow member 10 via the intermediate layer 13. When the particle velocities $u_1$ and $u_2$ are each of a negative value, on the other hand, the particle velocity $u_0$ takes on a negative value and acts in the direction from the opening portion 14 to the hollow region 20. Thus, the intermediate layer 13 increases in dimension in the y direction and decreases in dimension in the z direction. At that time, the particle velocity $u_0$ acting from the opening portion 14 on the external space takes on a negative value, so that the intermediate layer 13 assumes a state as if it were retracting to the hollow region 20 via the opening portion 14.

If the particle velocities $u_1$ and $u_2$ shown in Mathematical Expression (3) are used, the particle velocity $u_0$ of the gas molecules, acting on the opening portion 14 in the z direction of the opening portion 14 (vertical to the reflective surface 2), satisfies relationship of Mathematical Expression (4) below.

$$u_0(t) = \frac{S_p}{S_o}(u_1(t) + u_2(t)) \tag{4}$$

As shown in Mathematical Expression (4) above, the particle velocity $u_0$ depends on an area ratio between the area $S_p$ of the boundary surfaces 111 and 121 and the area $S_o$ of the opening portion 14. If the resonators 11 and 12 have the same resonance frequency and the same sectional area in the direction vertical to the reflective surface 2, the particle velocity $u_1$ equals the particle velocity $u_2$. Thus, if relationship of $2S_p/S_o>1$ is satisfied and the area $S_p$ of the boundary surfaces 111 and 121 is greater than a half (½) of the area $S_o$ of the opening portion 14, a particle velocity $u_0$ much higher than a sum of the particle velocities $u_1$ and $u_2$ can be produced at the opening portion 14, as may also be seen from mathematic Expression (4). Because the relationship of $S_p>S_o$ is satisfied in the hollow member 10, the particle velocity $u_0$ at the opening portion 14 satisfies a condition for being greater than the sum of the particle velocities $u_1$ and $u_2$.

Further, if Mathematical Expression (4) is used, a specific acoustic impedance ratio ζ when incident waves have fallen, from the external space, on the reflective surface 2 in the direction vertical to the reflective surface 2 (i.e., z direction) satisfies relationship defined in Mathematical Expression (5) below.

$$\zeta = \frac{1}{\rho c}\frac{p_0(t)}{u_0(t)} = j\cdot\frac{S_o}{S_p}\cdot\frac{\cos kl_1 + \cos kl_2}{\sin k(l_1 + l_2)} \tag{5}$$

As shown in Mathematical Expression (5), the specific acoustic impedance ratio ζ is a value calculated by dividing a specific acoustic impedance $p_o/u_o$ of the opening portion 14 by the characteristic impedance ρc (specific acoustic resistance) of the medium (air) of the opening portion 14. In short, the specific acoustic impedance ratio ζ is a ratio between a specific acoustic impedance of a given point in a sound field and a characteristic impedance of the medium at that point. Once incident waves belonging to the resonant frequencies fall on the opening portion 14 in the vertical direction, reflected waves produced by the resonance of the resonators 11 and 12 are radiated to the external space via the intermediate layer 13 and opening portion 14 in accordance with an intensity of the specific acoustic impedance ratio ζ satisfying the relationship defined in Mathematical Expression (5). Here, the specific acoustic impedance ratio ζ is equal to "r+jx" (i.e., ζ=r+jx). "r" is a real part of the specific acoustic impedance ratio ζ (i.e., Re(ζ), which is also sometimes called "specific acoustic resistance ratio". Further, "x" is an imaginary part of the specific acoustic impedance ratio ζ (i.e., Im(ζ), which is also sometimes called "specific acoustic reactance ratio". Next, a description will be given about relationship between the specific acoustic impedance ratio ζ and the reflected waves.

(I) In the case where ζ=0, i.e. r=0 and x=0:

Once incident waves fall on a region satisfying ζ=0 (r=0 and x=0), reflected waves having the same amplitudes as the incident waves and phase-displaced by 180 degrees from the incident waves are radiated from that region as reflected waves produced through resonance. In this way, the incident waves and the reflected waves interfere with each other so that the respective amplitudes of the incident waves and the reflected waves cancel out each other. Such resonance will hereinafter be referred to as "full resonance".

(II) In the case where ζ=1, i.e. r=1 and x=0:

Once incident waves fall on a region satisfying ζ=1 (i.e. r=1 and x=0), no reflected wave is radiated from that region. Such a phenomenon will hereinafter be referred to as "full sound absorption".

(III) In the case where ζ=∞, i.e. r=∞ and x=0:

Once incident waves fall on a region (i.e., rigid body) satisfying ζ=∞ (i.e. r=∞ and x=0), reflected waves having the same amplitude as the incident waves and having no phase displacement (zero-degree phase displacement) from the incident waves are radiated as reflected waves produced through reflection. In this case, the incident waves and the reflected waves interfere with each other in such a manner that standing waves are produced. Such a phenomenon will hereinafter be referred to as "full reflection".

(I) above each indicate the example where r=0 and the hollow member 10 has no resistance component, but the hollow member 10 may sometimes have a resistance component. In such a case, once sound waves having the resonant frequencies of the resonators 11 and 12 fall on or enter the hollow region 20, the real part r of the specific acoustic impedance ratio ζ in the opening portion 14 may sometimes take a value other than zero, i.e., as the cases (II) and (III) above. If the sound waves enter the opening portion 14, reflected waves produced through resonance and radiated from the opening portion 14 attenuate in amplitude in accordance with the resistance component contained in the hollow member 10. Namely, it may be regarded or considered that a "resonance phenomenon" where the resonators 11 and 12 radiate reflected waves produced resonance occurs, not only in the case of the full resonance where the specific acoustic impedance ratio ζ in the opening portion 14 is zero, but also in other cases.

Note that a specific acoustic impedance ratio ζ=r+jx and a complex sound pressure reflection coefficient R=|R|exp(jϕ) at a given point of a region of a certain member satisfies relationship of R=(ζ−1)/(ζ+1). The complex sound pressure reflection coefficient is a physical quantity indicative of a complex number ratio between reflected waves and incident waves at a given point of a space. |R| is a value indicative of an amplitude of the reflected waves relative to the incident waves, and a greater value of |R| indicates that the reflected waves are relatively greater in amplitude than the incident waves. ϕ is a value indicative of a degree of phase variation of the reflected waves relative to the incident waves (hereinafter referred to as "phase variation amount"). As apparent from the above-mentioned relationship, if one of the specific acoustic impedance ratio ζ and the complex sound pressure reflection coefficient R is determined, then the other of the specific acoustic impedance ratio $\zeta$ and the complex sound pressure reflection coefficient R can be uniquely determined. For example, if $\zeta=0$ (namely, in the case of full resonance), the complex sound pressure reflection coefficient R becomes −1 (minus one), at which time the reflected waves assume an opposite phase to the incident waves and the reflected waves assume the same amplitude as the incident waves. If. $\zeta=1$ (namely, in the case of full sound absorption), the complex sound pressure reflection coefficient R becomes zero, at which time the complex sound pressure reflection coefficient R becomes zero and no reflected wave is radiated (i.e., the reflected waves assume a zero amplitude). Further, if $\zeta=\infty$ (namely, in the case of full reflection), the complex sound pressure reflection coefficient R becomes 1 (one), at which time the reflected waves assume the same amplitude and phase as the incident waves.

The following describe a sound absorbing effect and a sound scattering effect separately from the viewpoint of the phase and from the viewpoint of the amplitude. Note that the sound absorbing effect is an effect that is achieved by the reflected waves radiated from the opening portion 14, and the sound scattering effect is an effect that is achieved, in the hollow member 10, by an interaction between reflected waves radiated from the opening portion 14 and reflected waves radiated from the reflective surface 2. Details of an operation or action for achieving these effects will be described later.

First, the sound absorbing effect will be described from the viewpoint of the phase.

Figure 7:
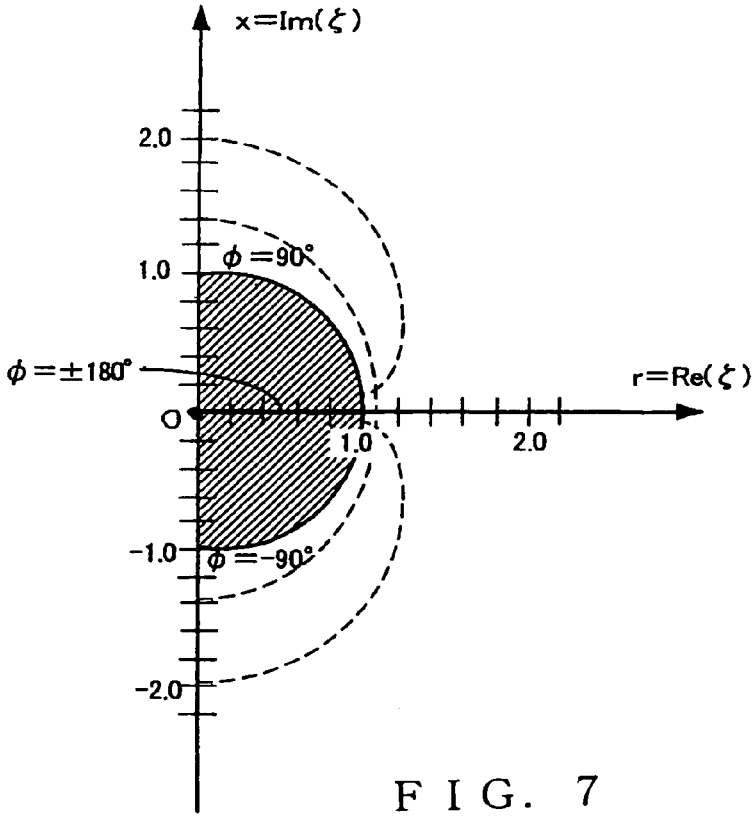
FIG. 7 is a graph showing relationship between specific acoustic impedance ratios and phase variation amounts.

FIG. 7 is a graph showing relationship between the specific acoustic impedance ratios $\zeta$ and the phase variation amounts $\phi$. In this graph, the horizontal axis represents the real parts of the specific acoustic impedance ratios $\zeta$ ($r=\mathrm{Re}(\zeta)$), while the vertical axis represents the imaginary parts of the specific acoustic impedance ratio $\zeta$ ($x=\mathrm{Im}(\zeta)$). In the figure, at a point where $\zeta=\infty$, a distance from the point of origin O is $\infty$, in which case the above-mentioned full reflection occurs so that the phase variation amount $\phi$ becomes zero degree.

Hatched region in FIG. 7 is where $|\zeta|<1$, in which case the phase variation amount $\phi$ is greater than 90 degrees. In the case where this condition is satisfied, the phase variation amount $\phi$ approaches ±180 degrees as the value of $|\zeta|$ becomes smaller. More specifically, if $x=\mathrm{Im}(\zeta)>0$, the phase variation amount $\phi$ approaches 180 degrees, while, if $x=\mathrm{Im}(\zeta)<0$, the phase variation amount $\phi$ approaches −180 degrees. Furthermore, if $0\leqq\mathrm{Re}(\zeta)<1$ and $\mathrm{Im}(\zeta)=0$, then the full resonance occurs, so that the phase variation amount $\phi$ becomes ±180 degrees. Particularly, as long as the value of the specific acoustic impedance ratio $\zeta$ falls within the hatched region in the graph of FIG. 7 and a region inside a circle of a radius "1" about the point of origin O (other than a portion on a semi-circular line), it is possible to effectively achieve a sound absorbing effect through phase interference between the incident waves and the reflected waves. If, on the other hand, the value of $|\zeta|$ is one or over as illustrated by a region indicated by broken line in FIG. 7, the phase variation amount $\phi$ is smaller than 90 degrees. In the broken-line region, a sound absorbing effect can be achieved although the sound absorbing effect through phase interference is reduced as compared to that achieved in the case where the value of $|\zeta|$ is below one. Further, the more there are phase differences other than the same phase between the reflected waves radiated from the opening portion 14 and the reflected waves radiated from the reflective surface 2 and the more the phase differences are close to the opposite phase, the more the scattering effect is enhanced. Thus, while it is possible to achieve the scattering effect in the case that the value of $|\zeta|$ is "1" (one) or over, it is preferable that the value of $|\zeta|$ is less than "1" and it is more preferable to realized such a condition that the value of $|\zeta|$ is as close to "0" (zero) as possible and the phase variation amount $\phi$ is as close to ±180 degrees as possible.

Namely, for a resonance phenomenon to achieve a sound absorbing effect and/or a sound scattering effect, it is ideal that $\mathrm{Im}(\zeta)=0$ so that the phase variation amount $\phi$ becomes ±180 degrees; however, a sound absorbing effect and/or a scattering effect through resonance can be effectively achieved as long as at least one of the conditions of $90°\leqq\phi\leqq180°$ and $-180°\leqq\phi\leqq-90°$ is satisfied and the value of $|\zeta|$ is below one. Under the condition where the value of $|\zeta|$ becomes less than one, it is more preferable that a condition of $135°\leqq\phi\leqq180°$ or $-180°\leqq\phi\leqq-135°$ be satisfied, and it is even more preferable that a condition of $160°\leqq\phi\leqq180°$ or $-180°\leqq\phi\leqq-160°$ be satisfied.

Figure 8:
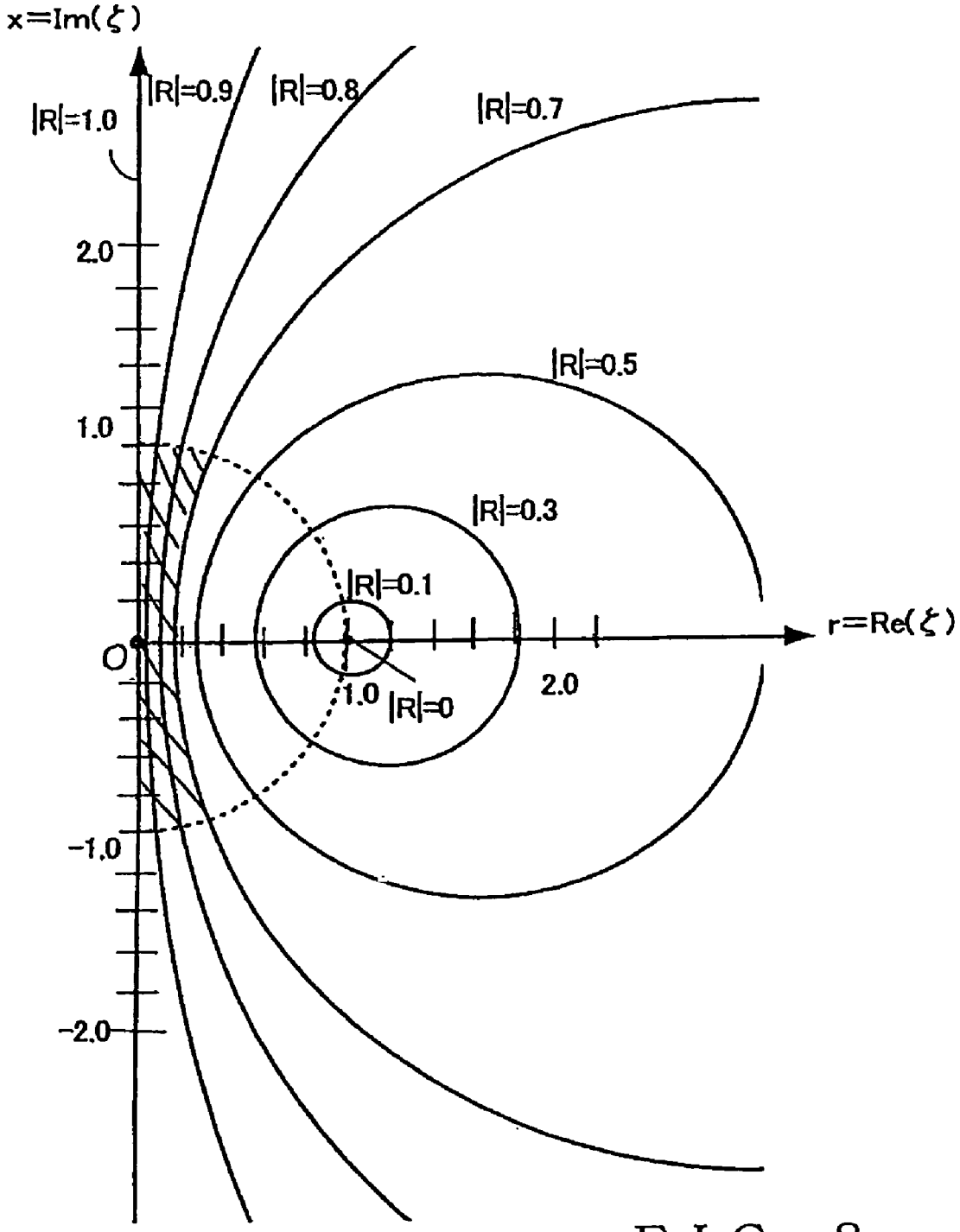
FIG. 8 is a graph showing relationship between specific acoustic impedance ratios and amplitudes of a complex sound pressure coefficient.

Next, the sound absorbing effect will be described from the viewpoint of the amplitude. FIG. 8 is a graph showing relationship between the specific acoustic impedance ratios $\zeta$ and the amplitudes $|R|$ of the complex sound pressure coefficient. In FIG. 8, there are shown values of $\mathrm{Re}(\zeta)$ and $\mathrm{Im}(\zeta)$ when the value of $|R|$ is 0.0, 0.1, 0.3, 0.5, 0.7, 0.8, 0.9 and 1.0. As illustrated in the figure, if $\mathrm{Re}(\zeta)=1$ and $\mathrm{Im}(\zeta)=0$, $|R|=0$, which indicates that the amplitude takes a minimum value of zero; namely, in this case, the full sound absorption occurs with no reflected wave produced.

Region indicated by broken line in the figure is the region where $|\zeta|$ equals one ($|\zeta|=1$), and, in a portion within this region (other than a portion on a semi-circular line), there are phase differences in a range of 90 to 180 degrees between the incident waves and the reflected waves. Because $|R|>0$ in that region, the reflected waves have an amplitude exceeding zero.

At a position on the vertical axis where $\mathrm{Re}(\zeta)=0$, the value of $|R|$ becomes 1.0 independently of the value of $\mathrm{Im}(\zeta)$. In this case, reflected waves having the same amplitude as the incident waves are radiated, which is most preferable, from the view point of the amplitude, for achieving a sound absorbing effect and/or a sound scattering effect in a condition that the incident waves and the reflected waves are out of phase. From the figure, it can be seen that, if $\mathrm{Re}(\zeta)<1$ and assuming that the value of $\mathrm{Im}(\zeta)$ is constant, the value of $|R|$ increases as the value of $\mathrm{Re}(\zeta)$ decreases. Namely, because if the value of the real part $x=\mathrm{Re}(\zeta)$ of the specific acoustic impedance ratio $\zeta$ is small, particularly almost 0 (zero), then the reflected waves assume a great amplitude irrespective of the value of $\mathrm{Im}(\zeta)$, when the incident waves and the reflected waves are out of phase, it is suitable for achieving a sound absorbing effect and/or a sound scattering effect through phase interference.

In the hollow member 10 employed in the instant embodiment, where the opening portion 14 is connected with the resonators 11 and 12 via the intermediate layer 13, a condition of $|\mathrm{Im}(\zeta)|<1$ is satisfied at a position of the opening portion 14 with frequencies near the respective resonant frequencies of the resonators 11 and 12. Thus, in this case, the reflected waves from the opening portion 14 are displaced in phase by 90 degrees or over from the incident waves. If $\mathrm{Re}(\zeta)=0.30$, the amplitude $|R|$ of the reflected waves is 0.54, so that reflected waves having an amplitude that is one half (½) or over of the amplitude of the incident waves are radiated. Namely, in the case where $\mathrm{Re}(\zeta)$ and $\mathrm{Im}(\zeta)$ of the opening portion 14 are both sufficiently small, reflected waves having a sufficiently great amplitude and great phase variation relative to reflected waves from the reflective surface adjoining the opening portion 14 can be obtained from the opening portion 14. Ideally, if $\mathrm{Re}(\zeta)=0$ and $\mathrm{Im}(\zeta)=0$, $|R|=1.0$, so that the full resonance in which the incident waves and the reflected waves agree with each other in amplitude is achieved. However, if |R| is below 1.0, the following will take place.

Namely, if |R| is 0.5, for example, the sound absorbing effect and/or sound scattering effect can be effectively achieved by about a quarter (¼) of the energy of the incident waves being radiated from the opening portion 14. In this case, if Im(ζ)=0, then Re(ζ) is about 0.335, and the real part of the specific acoustic impedance Z takes a value of about 139.025 $Kg/m^3$·sec or below. It is preferable that the condition of |R|=0.7 be satisfied so that about a half (½) of the energy, of the incident waves is radiated from the opening portion 14; thus, in this case, an enhanced sound absorbing effect and/or sound scattering effect can be achieved very effectively. At that time, if Im(ζ)=0, Re(ζ) is about 0.175, and the real part of the specific acoustic impedance Z takes a value of about 72.625 $Kg/m^3$·sec or below. It is more preferable that the condition of |R|=0.9 be satisfied so that about ⅘ of the energy of the incident waves is radiated from the opening portion 14; thus, in this case, a prominent sound absorbing effect can be achieved. At that time, if Im(ζ)=0, Re(ζ) is about 0.55, and the real part of the specific acoustic impedance Z takes a value of about 22.825 $Kg/m^3$·sec or below.

In a preferred example where |R|≦0.7 as indicated by hatching in FIG. 8, for example, Re(ζ) is less than about 0.175, and in a more preferred example where |R|≦0.9 as indicated by hatching in FIG. 8, for example, Re(ζ) is less than about 0.055. In view of these examples, a good sound absorbing effect can be achieved by constructing the intermediate layer 13 of the hollow member 10 in such a manner that Re(ζ) is made substantially zero.

As also seen from the relationship defined in Mathematical Expression (5) above, the absolute value |ζ| of the specific acoustic impedance ratio ζ can be varied by varying an area ratio $S_o/S_p$ between the area $S_p$ of the boundary surfaces 111 and 121 and the area $S_o$ of the opening portion 14 (hereinafter "area ratio $r_s$").

Figure 9:
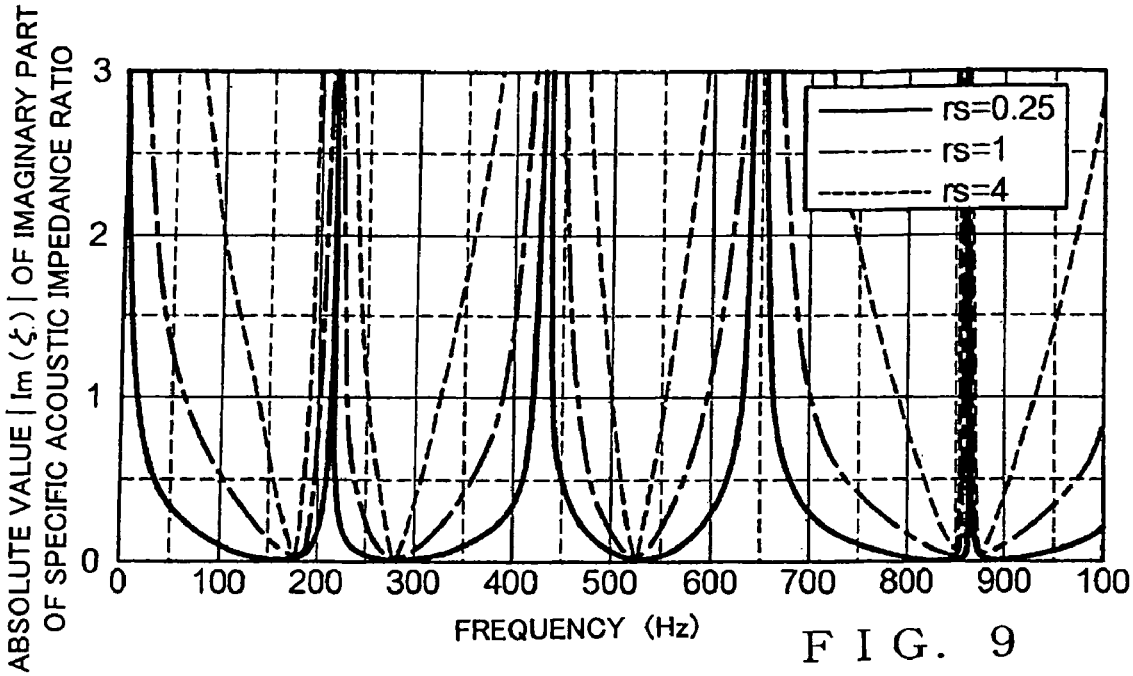
FIG. 9 is a diagram showing frequency characteristics of an imaginary part of a specific acoustic impedance ratio.

FIG. 9 is a diagram showing frequency characteristics of the absolute value |Im(ζ)| of the imaginary part of the specific acoustic impedance ratio ζ in a case where $l_1$=300 mm and $l_2$=485 mm. More specifically, FIG. 9 shows respective calculated values of the absolute value |Im(ζ)| in cases where the area ratio $r_s$ is 0.25, 1.0 and 4.0; note that, in this case, $l_1 \neq l_2$. The reason why the calculated values of absolute value |Im(ζ)| are shown in FIG. 9 is to allow readers of the specification to intuitively recognize from the figure that, in a range where the condition of |Im(ζ)|<1 is met, the phase variation amount ϕ takes values in a range of 90°≦ϕ≦180° or −180°≦ϕ≦90°. Note that a condition of |Im(ζ)|=∞ is established when anti-resonance occurs, and the sign of Im(ζ) reverses at the frequency in question, i.e. with that frequency as a boundary point.

As seen from the figure, as the area $S_p$ of the boundary surfaces 111 and 121 increases as compared to the area $S_o$ of the opening portion 14, i.e. as the area ratio $r_s$ decreases, the frequency bands satisfying the condition of 0≦Im(ζ)<1 become wider. Further, as the area ratio $r_s$ decreases, the area of a region defined or surrounded by a straight line indicative of Im(ζ)=1.0 and a graph curve indicative of Im(ζ) increases. In other words, the frequency bands that may be regarded as frequency bands where the "resonance phenomenon" occurs in response to incident waves entering or falling on the opening portion 14 becomes wider and a phenomenon close to the full resonance (ζ=0) occurs in wider frequency bands.

As further seen from the figure, if the area ratio $r_s$ is smaller than 1.0 ($r_s$<1.0), the degree of the above-mentioned effect achievable in the instant embodiment can be enhanced as compared to that achievable with an acoustic pipe of the conventional construction where the area ratio $r_s$ is 1.0. Preferably, the area ratio $r_s$ is set to be equal to or smaller than 0.5, in which case the area of the above-mentioned surrounded region in the instant embodiment increases by a factor of about 1.2 as compared to that in the conventional acoustic pipe and the value |Im(ζ)| decreases to less than about a half of that in the conventional acoustic pipe. In this way, more enhanced sound absorbing effect and/or sound scattering effect can be achieved. More preferably, the area ratio $r_s$ is set to be equal to or smaller than 0.25, in which case the area of the above-mentioned surrounded region in the instant embodiment increases by a factor of about 1.5 as compared to that in the conventional acoustic pipe and the value |Im(ζ)| decreases to less than about a quarter (¼) of that in the conventional acoustic pipe, so that the instant embodiment can achieve a remarkable advantageous benefit as compared to the conventional acoustic pipe.

As described above, the instant embodiment of the acoustic structure 1 of the present invention is constructed to achieve an effective sound absorbing effect and/or a sound scattering effect through a resonance phenomenon by defining the area ratio $r_s$ as noted above and by setting an absolute value |ζ| of the specific acoustic impedance ratio in the opening portion 14 to satisfy the condition of ζ<1 and making the rear part r=Re(ζ) of the specific acoustic impedance ratio almost zero through the behavior of the intermediate layer 13.

In the intermediate layer 13 and opening portion 14 of the hollow member 10 in the instant embodiment, there is provided no member, such as a resistance member, that blocks motions of gas particles. Further, by the setting of the area ratio $r_s$, a great particle velocity can be produced in the opening portion 14 through resonance of the resonators 11 and 12. Further, because the condition of |ζ|<1 is satisfied at the opening portion 14, a sound pressure thereat is considerably reduced through the phase interference produce by the resonance phenomenon (ideally, reduced to 0). In this way, because the hollow member 10 is constructed so that a phenomenon of a great particle velocity of gas molecules and a small sound pressure is produced in the opening portion 14 through resonance of the resonators 11 and 12, it is possible to achieve the condition that the real part r=Re(ζ) of the specific acoustic impedance ratio ζ is made almost zero. As set forth above, it is preferable that the value of Re(ζ) be zero. The same preferable condition can be realized by the construction of the hollow member 10 through the resonance of the resonators 11 and 12.

Figure 10A:
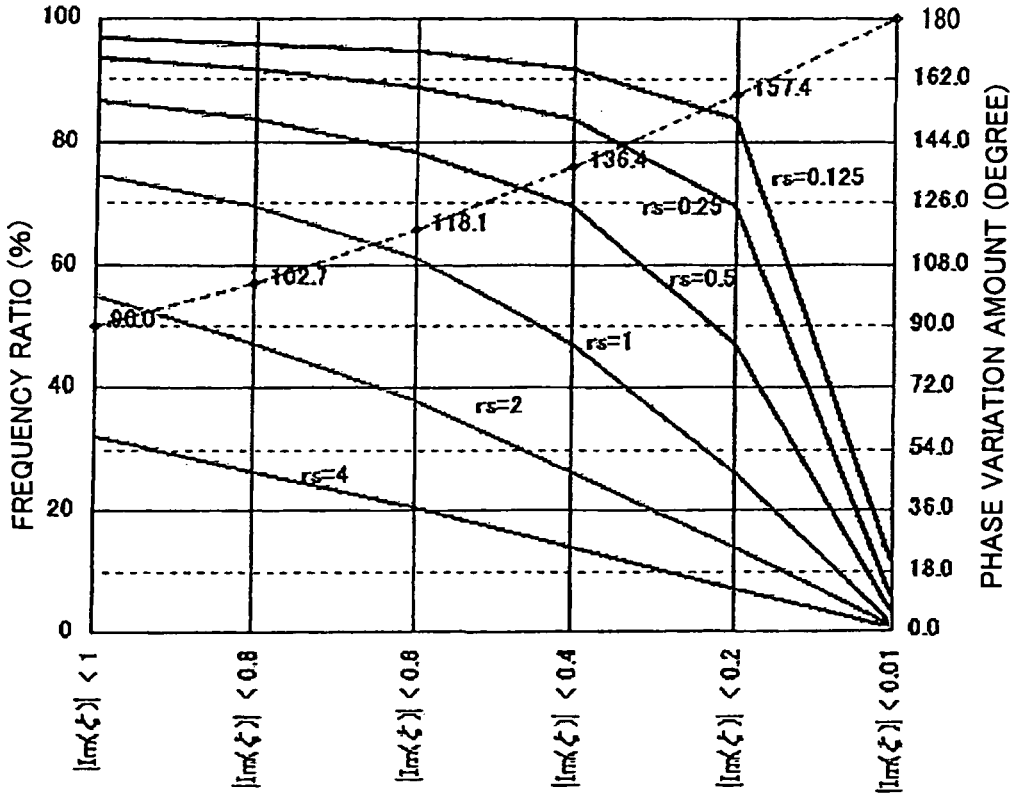
FIGS. 10A and 10B are graphs showing relationship between frequency ratios of frequencies at which $|\mathrm{Im}(\zeta)|$ falls below given values and area ratios.
Figure 10B:
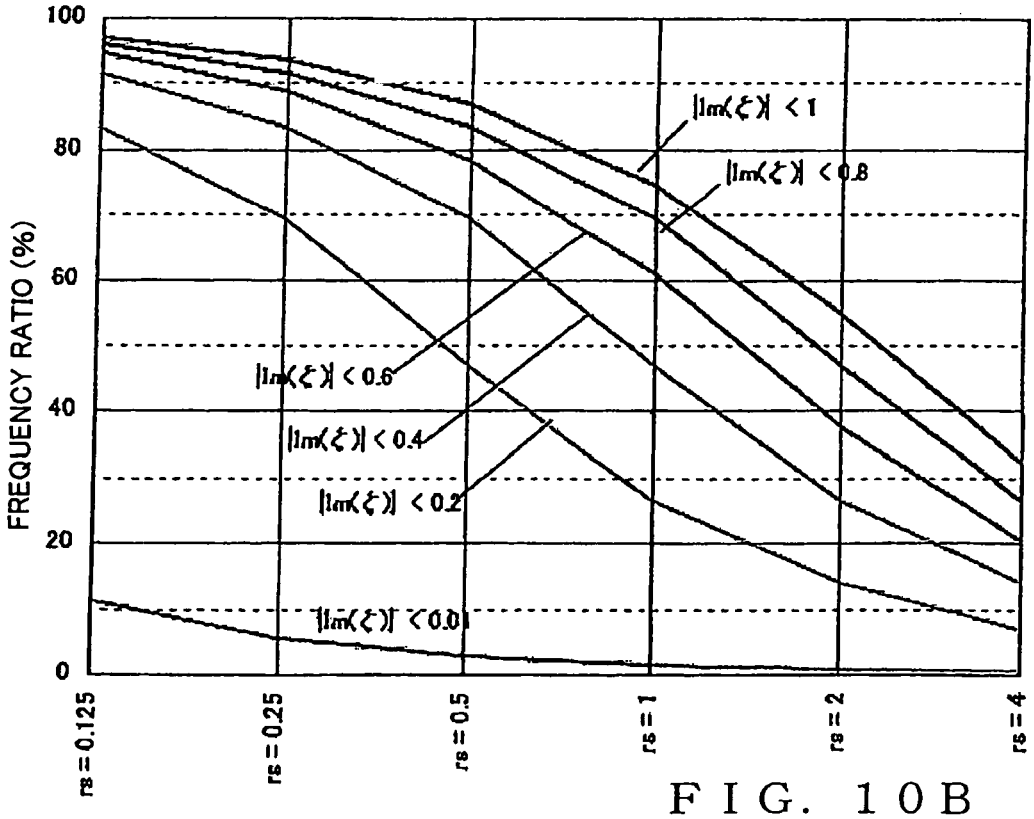

FIGS. 10A and 10B are graphs showing relationship between a frequency ratio, to frequency bands from 0 Hz to 1,000 Hz, of frequencies at which |Im(ζ)| falls below given values and the area ratio $r_s$. In FIG. 10A, the horizontal axis represents |Im(ζ)|, while the vertical axis represents the frequency ratio (%) and the phase variation amount (degree). In FIG. 10B, the horizontal axis represents the area ratio $r_s$, while the vertical axis represents the frequency ratio (%). Note that, in FIG. 10A, a lower limit of the reflected wave phase variation amount per value of |Im(ζ)| is plotted by a broken-line graph curve. The frequency ratio is a ratio, to the frequency bands from 0 Hz to 1,000 Hz, of frequency bands where |Im(ζ)| falls below the given values. Here, let it be assumed that the given values set for |Im(ζ)| are 0.1, 0.2, 0.4, 0.6, 0.8 and 1.0. FIGS. 10A and 10B indicate calculated results in a case where Re(ζ)=0; in this case too, $l_1$=300 mm and $l_2$=485 mm.

As clear from FIG. 10A, a ratio at which the reflected wave phase variation amount increases by more than a given value increases as the area ratio $r_s$ decreases (namely, as the opening portion 14 decreases in area). Where the area ratio $r_s$ is 0.25, for example, the frequency ratio at which $|Im(\zeta)|$ falls below 0.2 is about 70%. With the conventionally-known scheme where the area ratio $r_s$ is 1.0, on the other hand, the frequency ratio is about 27%. It can be also seen from the figure that the frequency bands where the phase variation amount is equal to or greater than 157.4 degrees are about three times as many as those in the conventionally-known scheme. Further, as seen from FIG. 10B, the frequency ratio at which $|Im(\zeta)|$ falls below the given value increases as the area ratio $r_s$ decreases. From the results shown in FIG. 10 as well, it can be seen that the frequency bands where the reflected wave phase variation amount increases increase as the area ratio $r_s$ decreases.

Figure 11:
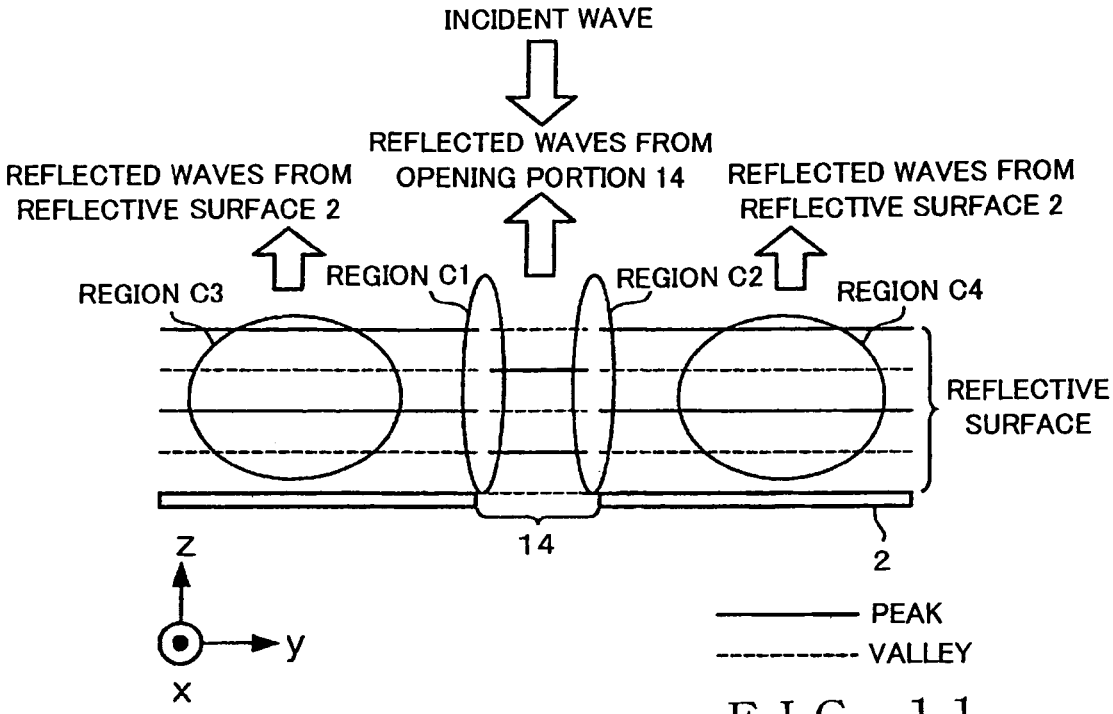
FIG. 11 is a diagram explanatory of behavior of sound waves in and around an opening portion in a reflective surface of the hollow member.

FIG. 11 is a diagram explanatory of reflected waves at the time of resonance when the external space around the opening portion 14 of the hollow member 10 is viewed in the y-z plane direction. Particularly, FIG. 8 shows that a peak of incident waves where sound pressure is maximal arrives vertically at the reflective surface 2 and opening portion 14 and then reflected waves corresponding to the incident waves are produced. Let it be assumed here that the specific acoustic impedance ratio $\zeta$ of the opening portion 14 is zero ($\zeta=0$) and thus the above-mentioned "full resonance" occurs. Further, in the figure, the reflected waves are depicted by solid and broken lines; each of the solid lines depicts a position of a peak where the sound pressure of the reflected waves is maximal, while each of the solid lines depicts a position of a valley where the sound pressure of the reflected waves is minimal (assumes an opposite phase to the "peak").

Once incident waves belonging to the resonant frequencies arrive at or fall on the opening portion 14 of the hollow member 10, reflected waves phase-displaced by 180 degrees from the incident waves are radiated in the z direction through the opening portion 14, as reflected waves produced through resonance. Thus, as shown in the figure, the reflected wave in the opening portion 14 is a valley where the sound pressure is minimal. Because the hollow member 10 is formed of a reflective material having a relatively high rigidity coefficient, such as acryl resin, the hollow member 10 has a considerably great specific acoustic impedance ratio. Therefore, the reflected waves radiated from the reflective surface 2 have almost no phase displacement from the incident waves (see regions C3 and C4 in FIG. 11). If the reflective surface 2 is a rigid surface, then the above-mentioned "full reflection" occurs, and thus, the reflected waves radiated from the reflective surface 2 have the same phase as the incident waves with zero phase displacement from the incident waves. Namely, the full resonance occurs when the specific acoustic impedance ratio $\zeta$ of the opening portion 14 is zero, and when the full reflection has occurred with the specific acoustic impedance ratio of $\infty$, the reflected waves from the opening portion 14 and the reflected waves from the reflective surface 2 share the same amplitudes and are phase shifted from each other by 180 degrees. Thus, there occurs a phenomenon where the phase relationship between the reflected waves from the opening portion 14 and the reflected waves from the reflective surface 2 becomes discontinuous in mutually-adjacent regions (spaces) C1 and C2 lying in the z direction in adjoining relation to the boundaries between the opening portion 14 and the reflective surface 2 as depicted in two ellipses in FIG. 11.

Because of the occurrence of the aforementioned phenomena, the sound absorbing effect is achieved through resonance in and around the opening portion 14. The sound scattering effect is achieved through interaction between 1) phase interference between incident waves falling on the reflective surface 2 and resultant reflected waves and 2) phase interaction between incident waves entering regions in and around the opening portion 14 and reflected waves produced through resonance, and a flow of gas molecules is produced in and around the opening portion 14 by virtue of the above-mentioned interaction. Because the reflected waves from the opening portion 14 and the reflected waves from the reflective surface 2 differ from each other in phase angle and different phenomena occur in the adjoining space regions C1-C4 depending on the phase differences, the two acoustic phenomena, i.e. sound scattering effect and sound absorbing effect, can simultaneously occur according to the instant embodiment of the acoustic structure 1.

As seen from the relationship defined in Mathematical Expression (4), the particle velocity $u_0$ at the opening increases as the area $S_p$ of the boundary surfaces 111 and 121 increases as compared to the area $S_o$ of the opening portion 14, i.e. as the area ratio $r_s$ decreases. Thus, by the relationship of $S_p>S_o$ being satisfied, vibration of the gas molecules further increases in and around the opening portion 14, so that the sound scattering and sound absorbing effects can be further enhanced in the external space near the opening portion 14. As explained above, high sound scattering and sound absorbing effects can be achieved by the phase difference between the reflected waves from the reflective surface 2 and the reflected waves from the opening portion 14.

Further, as seen from the relationship defined in Mathematical Expression (5), the specific acoustic impedance ratio $\zeta$ depends on the size (area ratio $r_s$) of the intermediate layer 13, and thus, the phase relationship between the reflected waves from the reflective surface 2 and the reflected waves from the opening portion 14 too depends on the area ratio $r_s$. In an ideal state where no ununiformity in the sound pressure distribution occurs in the intermediate layer 13 when the reflective surface 2 achieves the full reflection and the resonators 11 and 12 achieve the full resonance, the reflected waves from the reflective surface 2 and the reflected waves from the opening portion 14 are placed in opposite-phase relationship. Further, even when there is a minute ununiformity in the sound pressure distribution in the intermediate layer 13, the sound scattering and sound absorbing effects can be achieved by virtue of the aforementioned actions as long as the intermediate layer 13 is constructed in such a manner that the reflected waves from the reflective surface 2 and the reflected waves from the opening portion 14 are placed in substantial opposite-phase relationship.

Figure 12A:
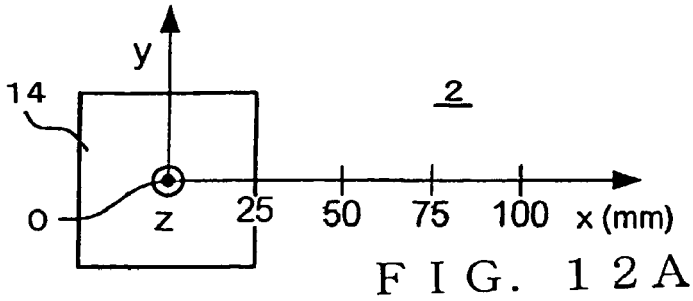
FIGS. 12A and 12B are diagrams showing actual measured values of relationship between distances from a center point of the opening portion and sound absorption coefficients.
Figure 12B:
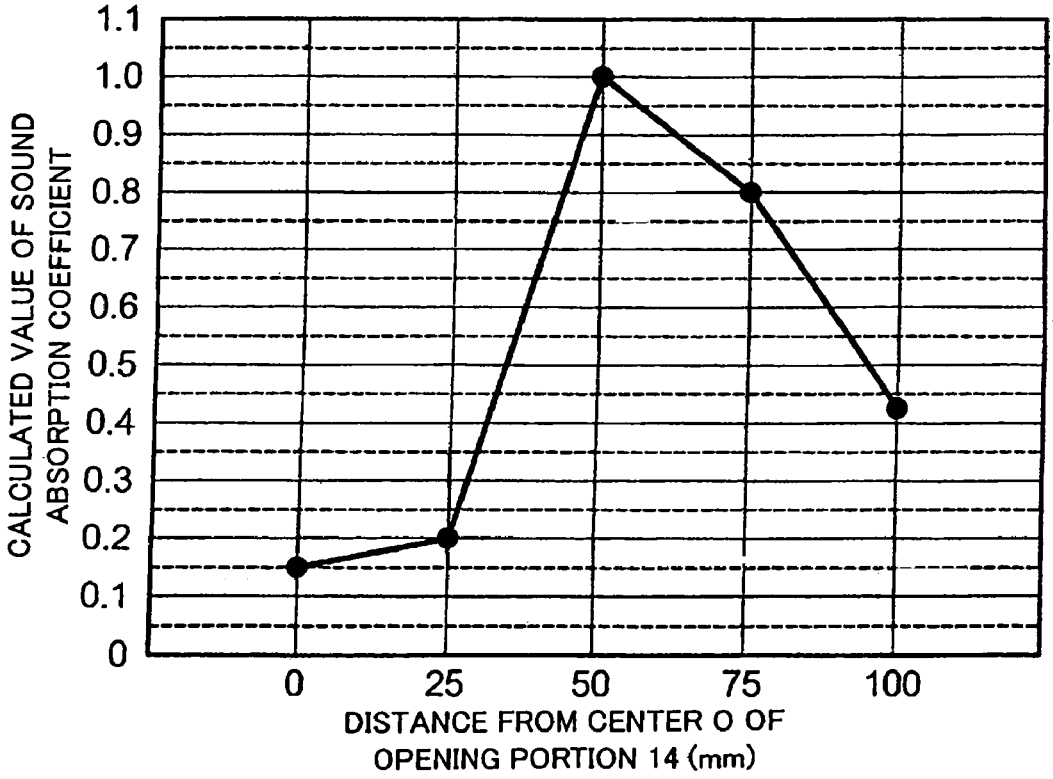

FIGS. 12A and 12B are diagrams showing results of experiments where relationship between distances from a center point O of the opening portion 14 and sound absorption coefficients in and around the opening portion 14 was obtained, of which FIG. 12A shows the opening portion 14 and its neighborhood in the direction parallel to the x-y plane while FIG. 12B shows the relationship between distances from a center point O of the opening portion 14 and sound absorption coefficients in and around the opening portion 14. The experiments used a resonator 11 where $l_1$=458 mm and the end 112 is an open end, and a resonator 12 where $l_2$=369 mm and the end 112 is a closed end. Further, the reflective surface 2 of the acoustic structure 1 has an area of 900 mm (y direction)×600 mm (x direction). Further, each of the sides of the opening 14 has a length d of 50 mm. Under such measurement conditions, pink noise was generated from a speaker installed at a position one meter away from the reflective surface 2 in the z direction, and measurement was made of the relationship between distances, in the direction parallel to the x-y plane, from the center point O of the opening portion 14 located at a zero-meter height from the reflective surface 2 (i.e., at the same height as the reflective surface 2)

and sound absorption coefficients; FIG. 12B shows actual measured values of the relationship.

FIG. 12B shows that high sound absorption coefficients are achievable at positions of the reflective surface 2 (z=0) located about 25 mm-100 mm (particularly 50 mm) in the direction parallel to the x-y plane from the center point O of the opening portion 14. Such positions are in the neighborhood of the opening portion 14 and on the reflective surface 2 near the opening portion 14. From such an experiment result too, it can be seen that a flow of gas molecules occurs in the external space near the opening portion 14 such that a high sound scattering effect is achievable, and that part of the energy of the reflective surface 2 flows into the regions C1 and C2 (FIG. 11) so that a high sound absorbing effect is achievable at a position located about as much as 100 mm away from the center point O of the opening portion 14.

Figure 13A:
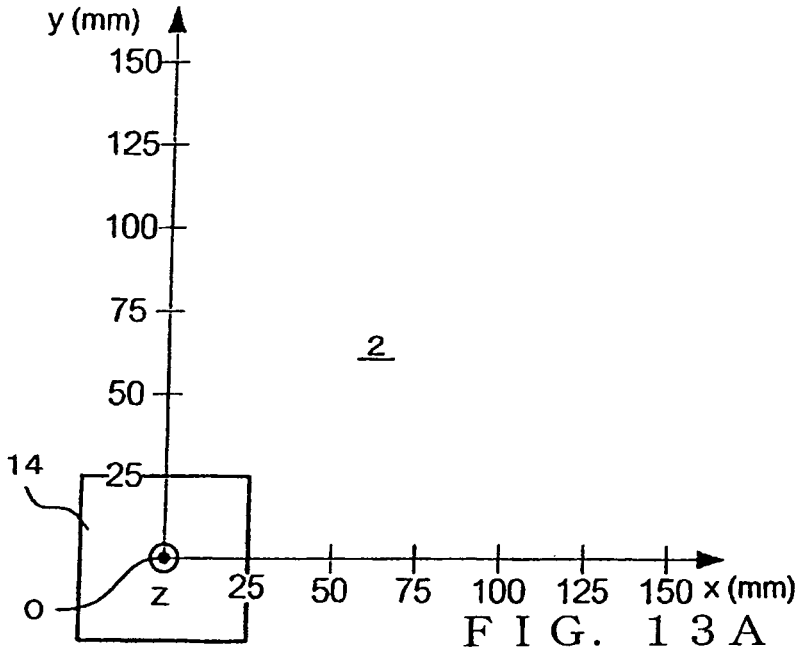
FIGS. 13A-13C are diagrams showing actual measured values of particle velocities in and around the opening portion.
Figure 13B:
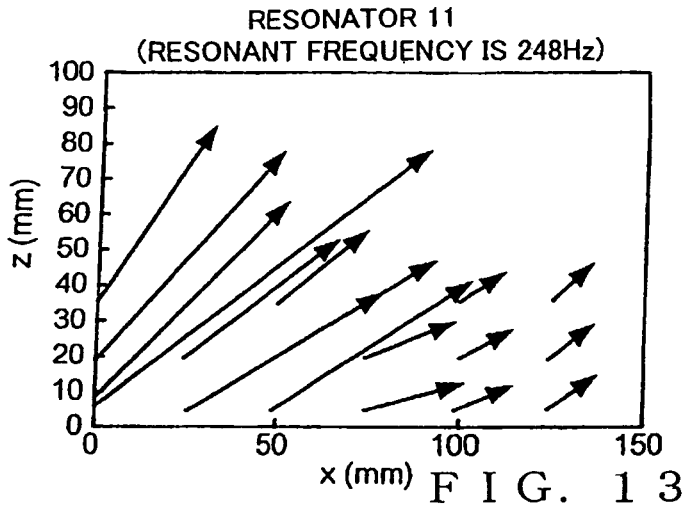
Figure 13C:
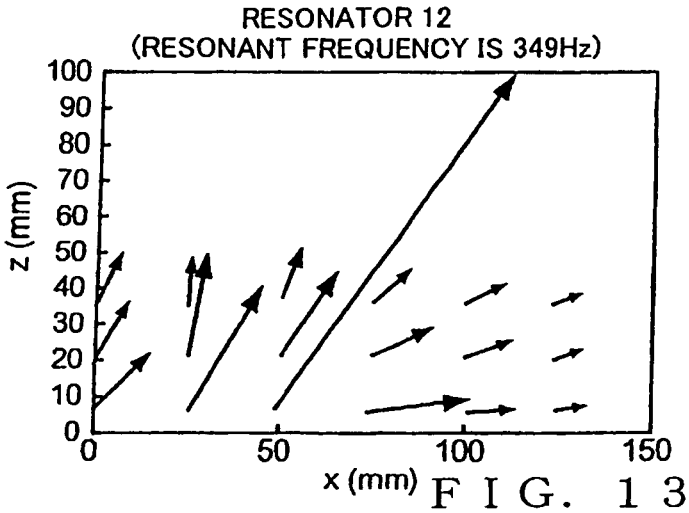

FIGS. 13A-13C are diagrams showing actual measured values of particle velocities under the aforementioned measurement conditions. More specifically, FIG. 13A shows the opening portion 14 and its neighborhood in the direction parallel to the x-y plane, where the x axis represents positions in the x direction as viewed from the center point O of the opening portion 14 while the y axis represents positions in the y direction as viewed from the center point O of the opening portion 14. Further, in FIG. 13A, arrows of the x and y axes represent directions in which the particle velocity acts, and lengths on the x and y axes represent intensities of the particle velocity. Further, FIG. 13B represents particle velocities when the resonator 11 has a resonant frequency of 248 Hz, and FIG. 13C represents particle velocities when the resonator 12 has a resonant frequency of 349 Hz.

The inventor of the present invention etc. confirmed that the particle velocity in a portion of the external space near the opening portion 14 is particularly great and is greater by about 40 dB than that on the reflective surface 2 as seen in the figures. Further, there occurs a high particle velocity having a component acting in the direction parallel to the x-y plane in response to incident waves entering the opening portion 14 in the vertical direction (z direction). Through this action, high sound absorbing and sound scattering effects can be achieved over a wide region on the reflective surface 2 near the opening portion 14.

According to the above-described acoustic structure 1 of the present invention, a good sound scattering effect can be achieved by virtue of a flow of kinetic energy of gas molecules produced in an oblique direction, not perpendicular to the reflective surface 2 and opening portion 14, through the interaction between 1) phase interference between incident waves falling on the reflective surface 2 and resultant reflected waves and 2) phase interaction between incident waves entering regions in and around the opening portion 14 and reflected waves produced through resonance. Further, a good sound absorbing effect can be achieved by the reflected waves from, the opening portion 14 canceling out the amplitude of the incident waves to the opening portion 14 through the phase interference. As a result, sound absorbing and sound scattering effects can be achieved over wide frequency bands and over a wide region near the opening portion 14. Particularly, in the case where the relationship of $S_p > S_o$ is satisfied, the specific acoustic impedance ratio $\zeta$ in the opening portion 14 even further decreases and the frequency bands over which the sound absorbing effect is achievable can be even further widened, and thus, the above-described acoustic structure 1 of the present invention can even further enhance the sound absorbing and sound scattering effects.

Furthermore, because the opening portions 14-1-14-10 differ in position among the hollow members 10-1-10-10 constituting the acoustic structure 1, the hollow members 10-1-10-10 have different resonant frequencies, so that a high sound absorbing effect is achievable over wide frequency bands including low frequency bands. In addition, because the dimension, in the thickness direction (z direction), of the acoustic structure 1 is considerably great as compared to the wavelengths of the resonant frequencies, the acoustic structure 1 would not require a great installation space, i.e. would not take up much of a limited available installation space.

The acoustic structure 1 of the present invention arranged in the above-described manner can not only effectively absorb and scatter sounds but also achieve appropriate sound absorbing and sound scattering effects over wide frequency bands, while preventing increase in size of the acoustic members. Further, the acoustic structure 1 of the present invention is constructed to achieve an appropriate sound absorbing effect by producing a high particle velocity without using a separate member, such as a resistance member, for restraining vibration of the gas molecules; the acoustic structure 1 can achieve a superior sound absorbing effect particularly at positions on the reflective surface 2 located remotely from the opening portion 14. Further, the inventor of the present invention etc. constructed a panel of a size of 900 mm (dimension in the x-axis direction)×600 mm (dimension in the y-axis direction)×28 mm (dimension in the z-axis direction) using the acoustic structure 1, arranged ten such panels and actually measured sound absorption coefficients in a reverberation room. The actual measurement showed that sound absorption coefficients of about 0.25 to 0.40 were obtained in frequency bands from 125 Hz to 4,000 Hz, as a result of which the inventor of the present invention etc. confirmed that the acoustic structure 1 of the present invention can achieve a flat sound absorbing characteristic that can never be achieved by other acoustic structures using a glass wool panel or plywood. Thus, it is highly expected that the knowledge and teachings provided by the present invention will be effectively applied to future development of acoustic members.

The acoustic structure 1 of the present invention may be modified various as exemplified by the following modifications, and these modifications may be combined as desired. Note that, in the following modifications too, the ends 112 and 122 of the hollowing member 10 may be closed ends or open ends, or a combination of closed and open ends unless stated otherwise.

[Modification 1]

The above-described preferred embodiment of the acoustic structure 1 comprises the separate hollow members 10-1-10-10 having their respective hollow regions 20-1-20-10 formed therein. As a modification, the acoustic structure 1 may have a large hollow region of a rectangular parallelepiped shape formed therein and extending in a same single direction (e.g., y direction), and the large hollow region may be partitioned with a plurality of partition members each extending in the y direction to thereby provide hollow regions 20-1-20-10 similar to those in the above-described preferred embodiment. Such a modified acoustic structure can achieve the same advantageous benefits as the above-described preferred embodiment of the acoustic structure 1.

Further, whereas the preferred embodiment of the acoustic structure 1 has been described as constructing one surface thereof as the reflective surface 2, the opening portions 14 may also be formed in another surface opposite from the reflective surface 2, so that sound absorbing and sound scattering effects as set forth above in relation to the above-described preferred embodiment are achievable on the two surfaces of the acoustic structure 1. Further, the opening portions 14 may be covered with nonwoven cloth, net, mesh or the like having sound pressure permeability and breathability (particle velocity permeability) and having a resistance component sufficiently smaller than the specific acoustic resistance of the medium (air), as long as sound waves can propagate between the external space and the hollow regions via the opening portions 14.

[Modification 2]

Figure 14A:
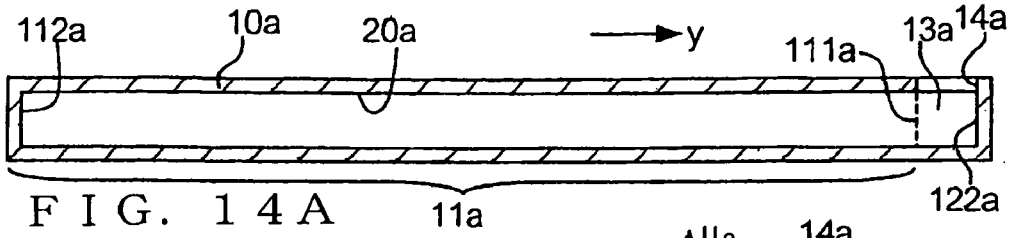
FIG. 14A is a sectional view of a modified hollow member.
Figure 14B:
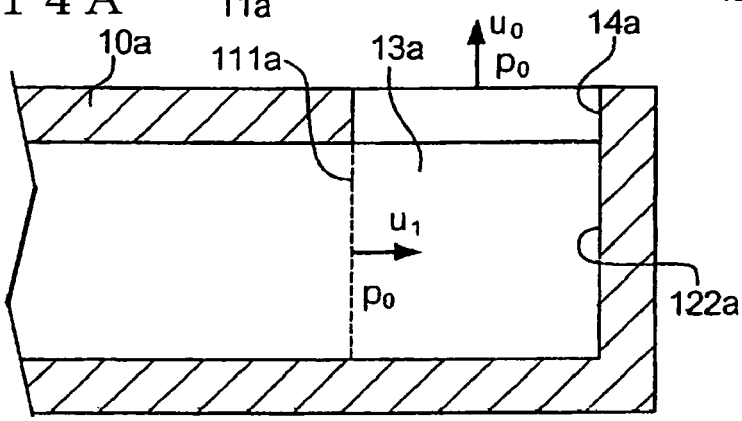
FIG. 14B is a sectional view explanatory of behavior of an intermediate layer of the hollow member when resonators have resonated.

In the above-described preferred embodiment of the acoustic structure 1, the hollow member 10 includes two resonators 11 and 12. As a modification, the hollow member may include only one resonator. FIGS. 14A and 14B are sectional views, similar to FIG. 3 (sectional view taken along the III-III line of FIG. 2), showing such a modified hollow member 10*a*.

As seen in FIG. 14A, the modified hollow member 10*a* has the hollow region 20*a* extending in the y direction and includes a resonator 11*a* formed to extend from closed one end 112*a* to the intermediate layer 13*a*. Further, the opening portion 14*a* is formed in a surface having the reflective surface 2*a* adjoining the other end 122*a* of the hollow member 10*a*; a portion of the hollow region 20*a* located adjacent to the opening portion 14*a* is the intermediate layer 13*a*. In such a modified construction, as shown in FIG. 14B, only one resonator is constructed to extend from the one end 112*a* to the intermediate layer 13*a*, as shown in FIG. 14B. The intermediate layer 13 is constructed in such a manner that a surface thereof other than the boundary surface with the resonator adjoins the inner surface of the hollow member 10*a* or the opening portion 14*a*. In this modified construction too, sound pressure produced through resonance acts on the intermediate layer 13*a* via the boundary surface 111*a* between the resonator 11*a* and the intermediate layer 13*a*, the intermediate layer 13*a* causes the sound pressure to act on the external space via the opening portion 14*a* in accordance with an intensity of its volume velocity. Thus, in the external space near the opening portion 14*a*, the same actions as in the above-described preferred embodiment are realized.

Thus, even where the modified hollow member 10*a* constructed in the aforementioned manner is applied to the acoustic structure, appropriate sound absorbing and sound scattering effects can be achieved. In this case, however, the volume velocity acting on the intermediate layer 13*a* from the resonator 11*a* would be smaller than that in the above-described preferred embodiment, so that the particle velocity in the opening portion 14*a* tends to become small and thus the sound absorbing and sound scattering effects may decrease as compared to those achieved in the above-described preferred embodiment. However, the instant modification can advantageously even further reduce the size of the acoustic structure and thereby accomplish the advantageous benefit that the acoustic structure can be installed in an acoustic space with an increased ease and thus a degree of design freedom can be enhanced.

[Modification 3]

In the above-described preferred embodiment of the acoustic structure 1, the hollow member 10 is constructed to satisfy the relationship of $S_p>S_o$ (i.e., $r_s<1$). As a modification, such a relationship need not necessarily be satisfied. However, in the case where the relationship of $S_p>S_o$ (i.e., $r_s<1$) is satisfied as in the above-described preferred embodiment, the specific acoustic impedance ratio $\zeta$ approaches zero as seen from Mathematical Expression (5) so that the frequency bands over which a sound absorbing effect is achievable can be widened and a higher particle velocity occurs in the external space near the opening potion as seen from Mathematical Expression (4), which can contribute to accomplishment of appropriate sound scattering and sound absorbing effects. By contrast, even where $S_P \leqq S_o$, resonance of the resonators 11 and 12 can occur to achieve a sound absorbing effect, and an sound scattering effect is achievable through a flow of gas molecules caused by a high particle velocity in the opening portion 14, as long as the absolute value $|\zeta|$ of the specific acoustic impedance ratio $\zeta$ satisfies the relationship of $|\zeta|<1$.

[Modification 4]

Figure 15:
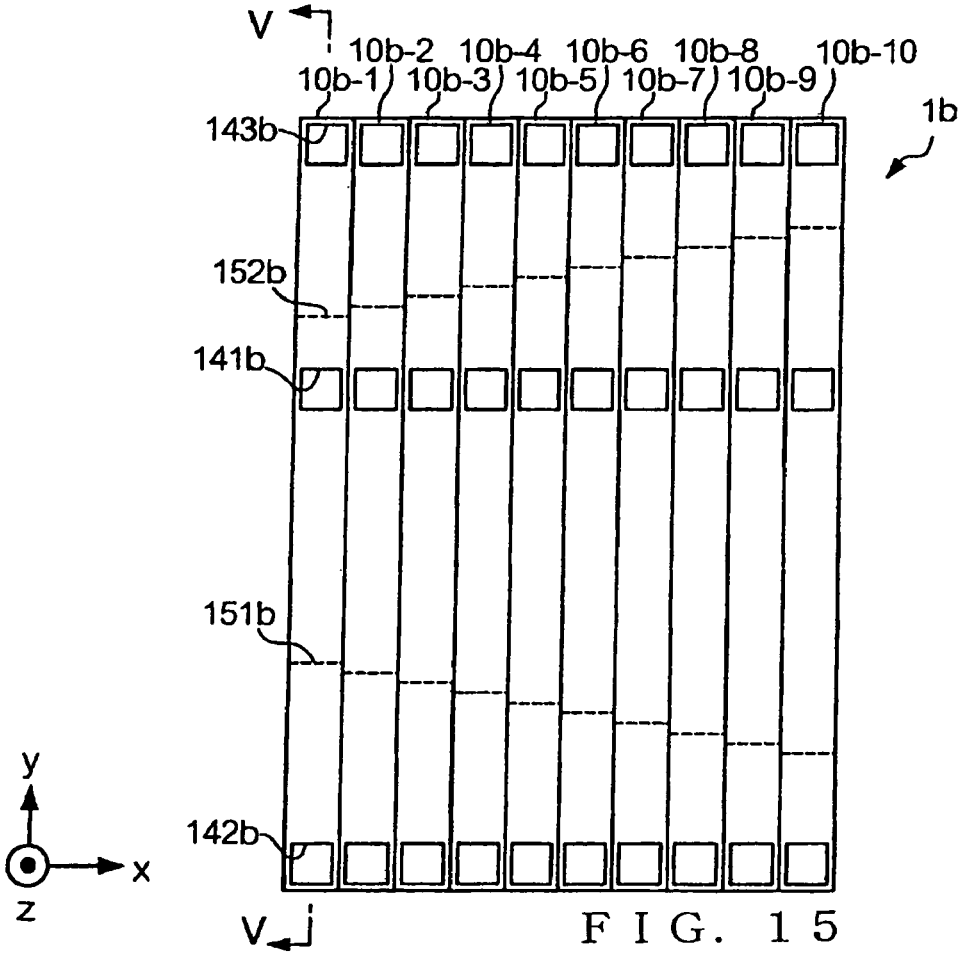
FIG. 15 is a view showing a construction of a modified acoustic structure.

The acoustic structure may be constructed as follows. FIG. 15 shows a modified acoustic structure 1*b* as viewed in the same direction as the arrow II in FIG. 1. Although not particularly shown in FIG. 15, a plurality of hollow regions each having a rectangular parallelepiped shape and extending in the y direction are formed at similar positions to those of FIG. 2.

As shown in FIG. 15, the modified acoustic structure 1*b* includes a plurality of the hollow members 10*b*-1-10*b*-10, each of which is closed as opposite ends and has opening portions 142*b* and 143*b* in portions of the reflective surface 2 near the opposite ends. Each of the hollow members 10*b*-1-10*b*-10 has another opening portion 141*b* formed therein at a position near the center in the y direction. Further, as indicated by broken lines, the modified acoustic structure 1*b* includes partition walls 151*b* and 152*b* provided in each of the hollow members 10*b*-1-10*b*-10 for partitioning the hollow region in the y direction into a plurality of partitioned hollow regions. In FIG. 15, only the hollow member 10*b*-1 is shown as having the opening portions 141*b*-143*b* and partition walls 151*b* and 152*b* to avoid complexity of illustration, and it should be clear that the other hollow members are constructed similarly to the hollow member 10*b*-1 although the positions of the opening portions and partition walls differ among the hollow members. The hollow members 10*b*-1-10*b*-10 are generally identical in construction, and thus, in the following description, the hollow members 10*b*-1-10*b*-10 will be collectively referred to as "hollow member 10*b*".

Figure 16:
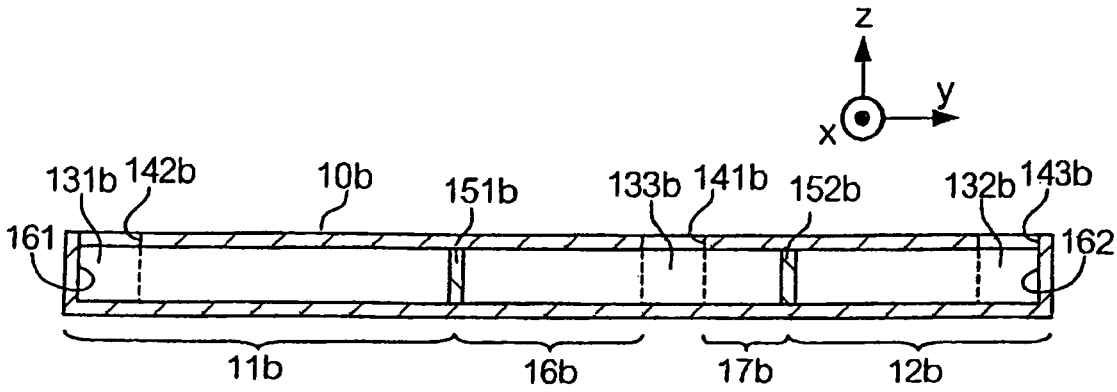
FIG. 16 is a sectional view of a hollow member of the modified acoustic structure taken along the V-V line of FIG. 15.

FIG. 16 is a sectional view of the hollow member 10*b* taken along the V-V line of FIG. 15 (i.e., along a plane vertical to the reflective surface). Because the two partition walls 151*b* and 152*b* are provided in the hollow member 10*b*, the hollow region is partitioned into three partitioned hollow regions in the y or extending direction of the hollow region (and hence the hollow member 10*b*). Note that the partition walls 151*b* and 152*b* may be formed either integrally with the hollow member 10*b* or separately from the hollow member 10*b*. Further, in one end portion of the hollow member 10*b*, the intermediate layer 131*b* is provided between one end 161 and the resonator 11*b*. In another end portion of the hollow member 10*b*, an intermediate layer 132*b* is provided between the other end 162 and the resonator 12*b*. Further, in a middle portion of the hollow member 10*b*, another resonator 16*b* is provided between the partition wall 151*b* and an intermediate layer 133*b*, and still another resonator 17*b* is provided between the partition wall 152*b* and the intermediate layer 133*b*.

Namely, in the hollow member 10*b*, the hollow region is partitioned by the partition walls into the plurality of partitioned hollow regions in the extending direction of the hollow member 10*b*, and the resonators are provided between the partition walls and the intermediate layers. With such a construction, the hollow member 10*b* can include four resonators, i.e. a greater number of resonators than those in the above-described preferred embodiment. Thus, the acoustic structure 1*b* can achieve sound absorbing and sound scattering effects over even wider frequency bands than the acoustic structure 1. Further, the hollow member 10*b* may include a greater number of partition walls than the above-mentioned so as to provide a greater number of partitioned hollow regions.

[Modification 5]

The above-described preferred embodiment of the acoustic structure 1 is installed on the inner wall surface and/or ceiling surface of an acoustic room so that the opening portions 14-1-14-10 face, i.e. are exposed to, an acoustic space that is an external space. As a modification, the acoustic structure 1 may be embedded in the inner wall surface and/or ceiling surface of the acoustic room so that the opening portions 14-1-14-10 are not exposed to the acoustic space. Further, moving means, such as casters, may be provided on a surface of the acoustic structure 1 other than the reflective surface 2, so as to construct the acoustic structure 1 as a movable panel.

Figure 17:
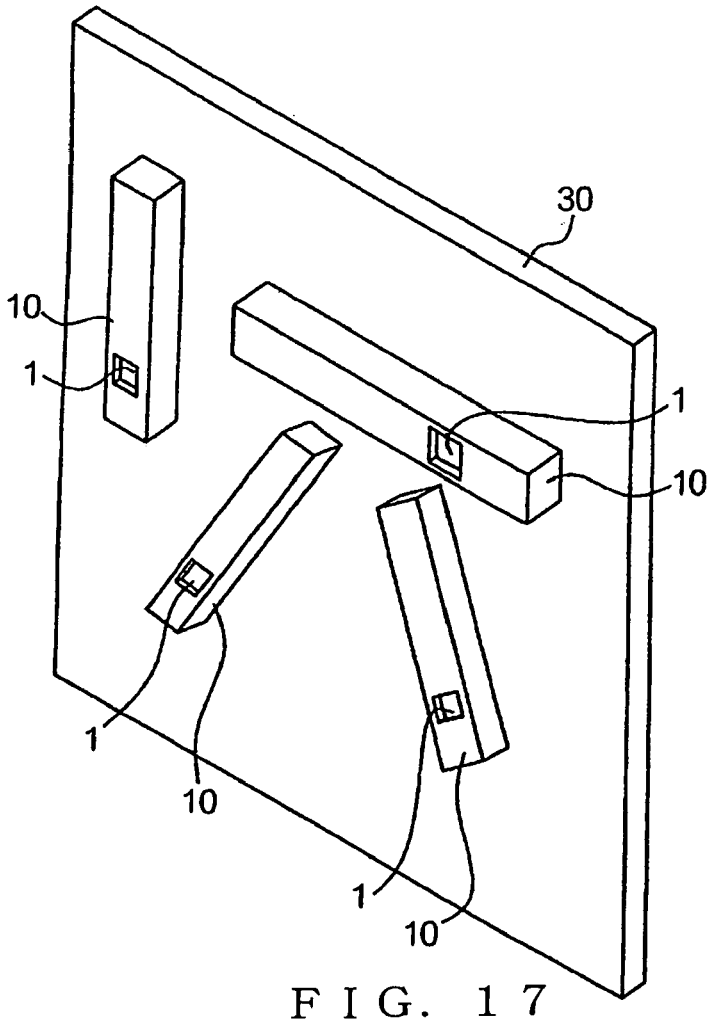
FIG. 17 is a view showing a construction of a modified acoustic structure.

Further, the plurality of hollow members 10 need not necessarily be provided to extend in one and the same direction and may be installed in any desired orientation or direction. For example, as shown in FIG. 17, the hollow members 10 may be provided on a support panel 30 of a flat plate shape in various orientations (extending directions). In the case where a multiplicity of the hollow members 10 are installed on the support panel 30 of a flat plate shape, an arrangement may be made such that installed positions, on the support panel 30, of the individual hollow members 10 can be changed. Further, where the hollow members 10 are installed on a single support panel 30, Moving means may be provided on the support panel 30 to permit movement of the support panel 30 having the hollow members 10 installed thereon.

[Modification 6]

Figure 18:
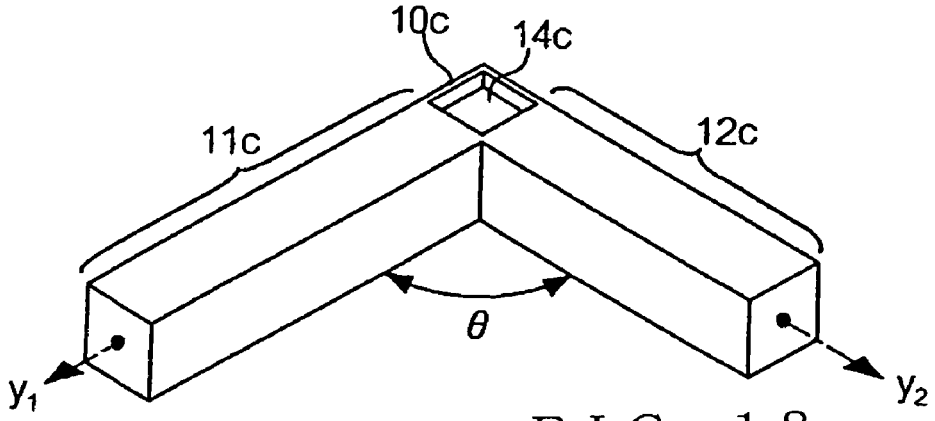
FIG. 18 is a perspective view showing an outer appearance of an example of a modified hollow member.

Whereas the hollow member 10 in the above-described preferred embodiment is constructed in such a manner that the two resonators 11 and 12 share the same center axis $y_o$, the two resonators 11 and 12 need not necessarily share the same center axis $y_o$. For example, the resonators 11 and 12 may be disposed at a predetermined angle relative to each other, e.g. in an "L" or "V" configuration. FIG. 18 is a perspective, view showing an example of a modified hollow member 10*c* constructed in the aforementioned manner. In the illustrated example of FIG. 18, two resonators 11*c* and 12*c* are disposed at a predetermined angle θ relative to each other (namely, the angle formed between the center axis $y_1$ of the resonator 11*c* and the center axis $y_2$ of the resonator 12*c* is θ) In this modification, the angle θ may be any desired angle. Such an angle θ of the hollow member 10 in the above-described preferred embodiment is 180 degrees. Even an acoustic structure provided with the hollow member 10*c* too can achieve sound absorbing and sound scattering effects as long as the intermediate layer provided between the opening portion 14*c* and the resonators 11*c* and 12*c* satisfies the same conditions as in the above-described preferred embodiment.

Figure 19A:
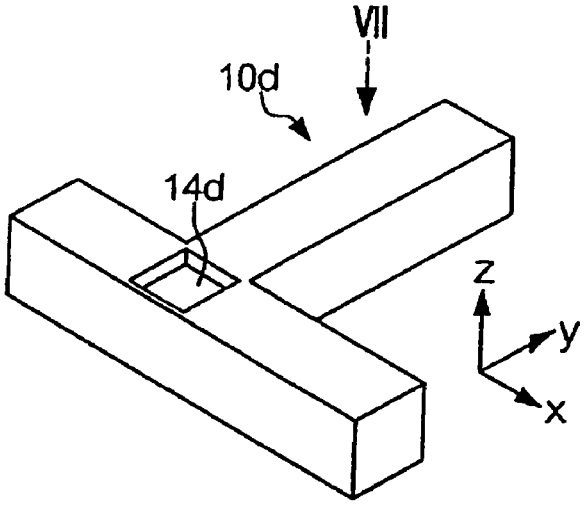
FIG. 19A is a perspective view showing an outer appearance of another example of the modified hollow member.
Figure 19B:
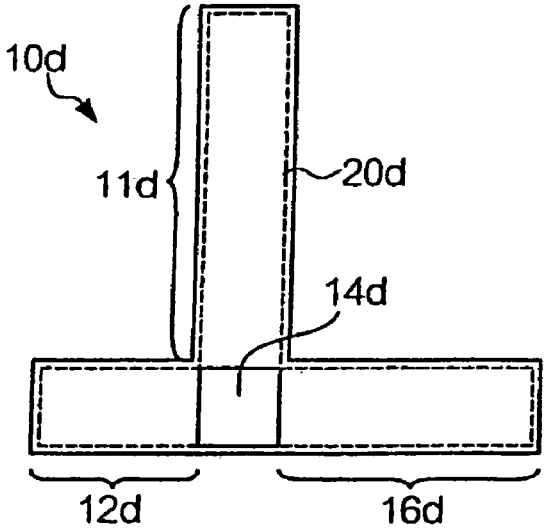
FIG. 19B is a view of the modified hollow member taken in a direction of an arrow VII of FIG. 19A.

FIG. 19A shows another example of the modified hollow member 10*d*, where the hollow region is formed in a "T" shape and three or more resonators are provided. FIG. 19B shows the modified hollow member 10*d* as viewed in a direction of an arrow VII of FIG. 19A. As shown, the hollow member 10*d* includes three resonators 11*d*, 12*d* and 16*d* provided between its individual ends and the intermediate layer communicating with the opening portion 14*d*. These resonators 11*d*, 12*d* and 16*d* are in communication with the opening portion 14*d* via the intermediate layer that is a portion of the hollow region 20*d* near the opening portion 14*d*. In this example too, the angles formed between the center axes of the resonators may be any desired angles. Further, the hollow member may be constructed in such a manner that four or more resonators face the intermediate layer. Furthermore, the resonators need not be disposed in the same plane (x-y plane) and may extend in any desired directions in the x-y-z space.

[Modification 7]

In the above-described preferred embodiment, the hollow member 10 is of a rectangular cylindrical shape, and the hollow region 20 is of a rectangular parallelepiped shape. As a modification, the hollow member constituting the acoustic structure may be formed as a cylindrical column or polygonal column (having a polygonal bottom surface). The hollow member may have a circular or polygonal cross-sectional shape (i.e., shape of a section formed by a plane cutting through the hollow member at right angles to the axis) and is not limited to the shape described in relation to the preferred embodiment. In short, it is only necessary that the hollow region extend in a single direction and has both the function achieved by the resonators and the function achieved by the intermediate layer 13. Further, the sectional shape of the hollow region 20 taken in the x-z plane too may be any other desired shape than that described in relation to the preferred embodiment. Further, such a sectional shape of the hollow region 20 need not be uniform throughout the length in the extending direction of the hollow region 20, as long as the hollow region 20 achieves both the function as the resonators and the function as the intermediate layer.

Figure 20A:
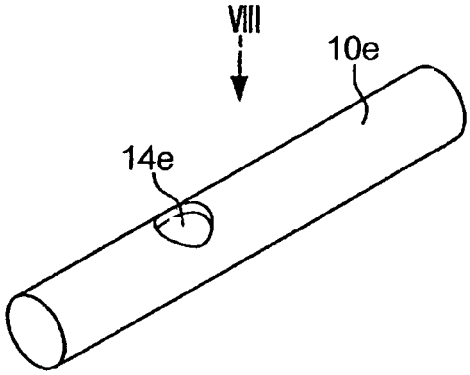
FIG. 20A is a perspective view showing an outer appearance of a modified hollow member of a tubular (or cylindrical) shape.
Figure 20B:
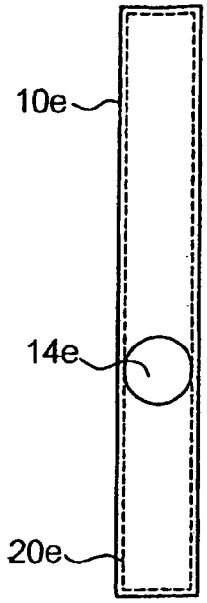
FIG. 20B is a view of the hollow member taken in a direction of an arrow VIII of FIG. 20A.

FIG. 20A is a perspective view showing an outer appearance of a modified hollow member 10*e* of a tubular (or cylindrical) shape. As shown, the hollow member 10*e* has a circular opening portion 14*e* in a surface thereof, and that surface functions as a reflective surface. FIG. 20B is a view of the hollow member 10*e* taken in a direction of an arrow VIII, where a broken line represents a position where the cylindrical hollow region 20 is provided. As shown, the opening portion 14*e* communicates the hollow region 20 with the external space via the opening portion 14*e*. Such a modified construction can achieve appropriate sound absorbing and sound scattering effects through generally the same actions as described in the preferred embodiment. Further, in a case where a plurality of the hollow members 10*e* are arrayed side by side in the direction perpendicular to the extending direction of the hollow members 10*e*, reflected waves are radiated from the curved reflective surfaces of the hollow members 10*e*, in response to incident waves falling on the hollow members 10*e*, so that a sound scattering effect can be achieved by virtue of phase discontinuity of the reflected waves produced by the opening 14*e* during resonance, although the curved reflective surfaces of the hollow members do not constitute a flat reflective surface as a whole.

[Modification 8]

Figure 21:
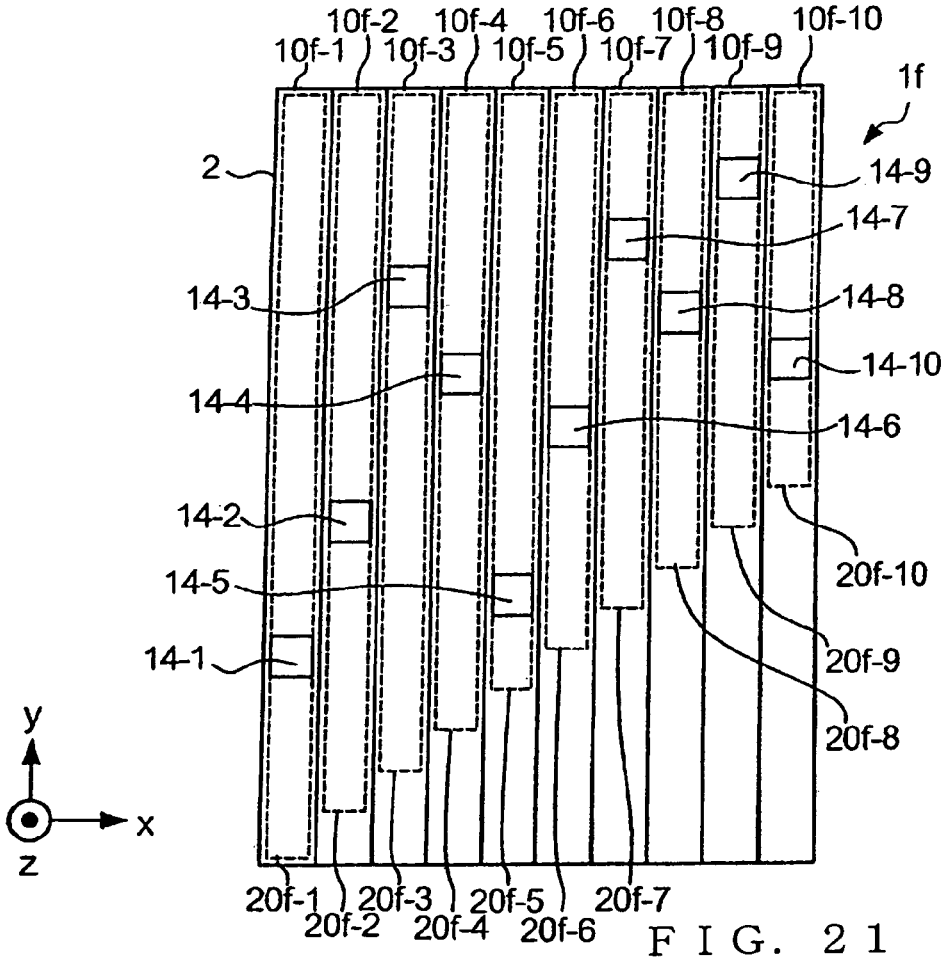
FIG. 21 is a view showing a construction of still another modified acoustic structure.

In the above-described embodiment, the hollow regions 20-1-20-10 of the acoustic structure 1 have the same length in the y direction or extending direction thereof. As a modification, the hollow regions 20-1-20-10 may have different lengths. FIG. 21 shows hollow regions 20*f*-1-20*f*-10 having different linear lengths in the extending direction that depend on the resonant frequencies of the resonators to be achieved. Such a construction allows resonant frequencies of the resonators to be determined with increased freedom and can thereby enhance the degree of design freedom of the acoustic structure. Needless to say, the hollow members themselves may have different lengths.

[Modification 9]

In the above-described preferred embodiment, where the lengths of the resonators 11 and 12 equal each other (i.e., $l_1=l_2$), the particle velocity $u_1$ at the boundary surface 111 and the particle velocity $u_2$ at the boundary surface 121 vary in phase with each other. Thus, the above-described preferred embodiment is suited to increase the particle velocity of gas molecules in the opening portion 14 in a given frequency band and thereby enhance sound absorbing and sound scattering effects in that frequency band. If, on the other hand, the resonators 11 and 12 have different lengths (i.e., $l_1 \neq l_2$), the absolute value $|\zeta|$ of the specific acoustic impedance ratio ζ becomes smaller than one ($|\zeta|<1$), so that the frequency bands over which sound absorbing and sound scattering effects are achievable can be widened. In this case, the absolute value $|\zeta|$ of the specific acoustic impedance ratio $\zeta$ of the opening portion 14 varies regularly, in response to variation of the frequency, on the basis of the relationship of Mathematical Expression (5). Thus, even where the individual frequency bands where the absolute value $|\zeta|$ of the specific acoustic impedance ratio $\zeta$ is smaller than one ($|\zeta|<1$) may become narrower than those in the case where $l_1=l_2$, the frequency bands satisfying the condition can be wider in the case where $l_1 \neq l_2$ than in the case where $l_1=l_2$, if the frequency bands satisfying the condition are added together. It can be said that such an advantageous benefit is achievable just because the acoustic structure achieves sound absorbing and sound scattering effects by not only achieving full resonance at the specific acoustic impedance ratio $\zeta$ of zero ($\zeta=0$) but also achieving a phenomenon that can be regarded as a resonance phenomenon when the absolute value of the specific acoustic impedance ratio $\zeta$ is smaller than one ($|\zeta|<1$). Even in this case, there can be achieved an advantageous benefit of an increased particle velocity, i.e. $u_0>u_1+u_2$ if the condition of $S_p>S_o$ is satisfied.

[Modification 10]

As another modification, the hollow members 10-1-10-10 constituting the acoustic structure 1 may each be open at the opposite ends so as to produce coupled vibration among the hollow members. In this case, sound waves radiated via the opened ends diffract around the open ends to radiate energy. Part of the radiated energy enters the hollow regions via the open ends of the adjoining hollow members 10. By producing the coupled vibration in the aforementioned manner, energy transfer takes place between the hollow members 10. During the coupled vibration, friction occurs on the inner wall surfaces of the hollow members 10 and a viscosity action occurs between gas molecules at the open ends, and thus, acoustic energy is consumed so that the sound absorbing effect can be even further enhanced.

[Modification 11]

The above-described preferred embodiment and modifications of the acoustic structure of the present invention can be installed in various acoustic rooms where acoustic characteristics are controlled. Here, the various acoustic rooms may be soundproof rooms, halls, theaters, listening rooms for acoustic equipment, sitting rooms like meeting rooms, spaces of various transport equipment, casings of speakers, musical instruments, etc., and so on.

This application is based on, and claims priority to, JP PA 2008-225317 filed on 2 Sep. 2008. The disclosure of the priority application, in its entirety, including the drawings, claims, and the specification thereof, is incorporated herein by reference.

What is claimed is:

1. An acoustic structure which comprises a hollow member, said hollow member comprising:

a hollow region formed in the hollow member;

an opening portion communicating the hollow region with an external space; and a reflective surface facing the external space and adjoining said opening portion, wherein a space portion of the hollow region adjoining and communicating with said opening portion is constructed as an intermediate layer, and a portion of said hollow region extending from one end of the hollow region to the intermediate layer is constructed as a resonator, and wherein a ratio of an area of the opening portion to an area of a boundary surface between the resonator and the intermediate layer is less than one.

2. The acoustic structure as claimed in claim 1, wherein the opening portion has a square shape with sides of distance d, and each side of the opening portion satisfies a relationship $d<\lambda/6$ with respect to a wavelength $\lambda$ corresponding to a resonance frequency of the resonator.

3. The acoustic structure as claimed in claim 1, wherein said intermediate layer is constructed in such a manner that, when the reflective surface radiates reflected waves corresponding to incident sound waves falling from the external space on said opening portion and the reflective surface of said hollow member, said intermediate layer not only causes reflected waves, produced through resonance of said resonator and differing in phase from the reflected waves from said reflective surface, to be radiated from said opening portion but also makes less than one an absolute value of a value obtained by dividing a specific acoustic impedance of said opening portion, at a time of radiation of the reflected waves from said opening portion, by a characteristic impedance of a medium of said opening portion for the incident sound waves of a resonance frequency band.

4. The acoustic structure as claimed in claim 3, wherein said intermediate layer is constructed in such a manner that, when the reflective surface radiates the reflected waves corresponding to the incident sound waves falling from the external space on said opening portion and the reflective surface of said hollow member, a real part of the value obtained by dividing the specific acoustic impedance of said opening portion by the characteristic impedance of the medium of said opening portion is substantially zero for the incident sound waves of the resonance frequency band.

5. The acoustic structure as claimed in claim 1, wherein a portion of said hollow member extending from a first end of the hollow region to the intermediate layer is constructed as a first resonator, and another portion of said hollow member extending from a second end of the hollow region to the intermediate layer is constructed as a second resonator.

6. The acoustic structure as claimed in claim 5, wherein the first and second resonators have a same resonance frequency, and wherein the first end is an open end and the second end is a closed end.

7. The acoustic structure as claimed in claim 5, wherein the first and second resonators have a same resonance frequency, and wherein the first end is a closed end and the second end is an open end.

8. The acoustic structure as claimed in claim 5, wherein the first and second resonators have a same resonance frequency, and wherein the first end is an open end and the second end is an open end.

9. The acoustic structure as claimed in claim 5, wherein the first and second resonators have a same resonance frequency, and wherein the first end is a closed end and the second end is a closed end.

10. The acoustic structure as claimed in claim 1, which further comprises one or more second hollow members each having a construction substantially the same as said hollow member, wherein said hollow member and said one or more second hollow members are arrayed side by side in a direction perpendicular to a direction in which the hollow members extend.

11. The acoustic structure as claimed in claim 10, wherein, of said hollow member and said one or more second hollow members, adjacent ends of an adjacent two or more hollow members are open ends.

12. The acoustic structure as claimed in claim 1, wherein the acoustic structure is configured to be embedded in at least one selected from an inner wall surface and a ceiling surface of a room.

13. The acoustic structure as claimed in claim 1 wherein said resonator is constructed in the hollow region, and said intermediate layer is constructed in such a manner that a surface thereof other than a boundary surface with said resonator adjoins an inner surface of said hollow member or said opening portion.

14. The acoustic structure as claimed in claim 1 wherein said intermediate layer is constructed in such a manner that sound pressure is distributed uniformly when said resonator resonates.

15. The acoustic structure as claimed in claim 10 wherein said hollow member and said one or more second hollow members differ from each other in length from one end of the hollow region to said intermediate layer.

16. An acoustic room comprising:

an acoustic structure having a hollow member, the hollow member including:

a hollow region formed in the hollow member;

an opening portion communicating the hollow region with an external space; and a reflective surface facing the external space and adjoining said opening portion, wherein a space portion of the hollow region adjoining and communicating with said opening portion is constructed as an intermediate layer, and a portion of said hollow region extending from one end of the hollow region to the intermediate layer is constructed as a resonator, and wherein a ratio of an area of the opening portion to an area of a boundary surface between the resonator and the intermediate layer is less than one.

* * * * *